US009878570B2

(12) United States Patent
Ishibashi

(10) Patent No.: US 9,878,570 B2
(45) Date of Patent: Jan. 30, 2018

(54) BOOKBINDING APPARATUS

(71) Applicant: RISO KAGAKU CORPORATION, Minato-ku, Tokyo (JP)

(72) Inventor: Tomokazu Ishibashi, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 269 days.

(21) Appl. No.: 14/808,663

(22) Filed: Jul. 24, 2015

(65) Prior Publication Data

US 2016/0039240 A1 Feb. 11, 2016

(30) Foreign Application Priority Data

Aug. 11, 2014 (JP) ..... 2014-163784

(51) Int. Cl.

| | |
|---|---|
| ***B42C 11/04*** | (2006.01) |
| ***B65H 37/04*** | (2006.01) |
| ***B42C 1/12*** | (2006.01) |
| ***B42C 9/00*** | (2006.01) |
| ***B42C 11/02*** | (2006.01) |
| ***B42C 19/02*** | (2006.01) |
| ***B42C 19/08*** | (2006.01) |

(52) U.S. Cl.

CPC ..... *B42C 11/04* (2013.01); *B42C 1/12* (2013.01); *B42C 9/0025* (2013.01); *B42C 11/02* (2013.01); *B42C 19/02* (2013.01); *B42C 19/08* (2013.01); *B65H 37/04* (2013.01)

(58) Field of Classification Search

CPC ..... B65H 37/04; B42C 1/12; B42C 9/0025; B42C 9/0037; B42C 11/02; B42C 19/02; B42C 19/08

USPC ..... 270/58.07, 58.08, 58.09, 58.11

See application file for complete search history.

(56) References Cited

U.S. PATENT DOCUMENTS

| | | | | |
|---|---|---|---|---|
| 6,857,796 | B2 | 2/2005 | Hatayama | |
| 7,263,328 | B2 * | 8/2007 | Asai | B42C 19/02 101/484 |
| 7,907,887 | B2 | 3/2011 | Asai et al. | |
| 7,946,565 | B2 * | 5/2011 | Kubota | B42C 9/0037 270/21.1 |

(Continued)

FOREIGN PATENT DOCUMENTS

| | | | |
|---|---|---|---|
| EP | 1264709 | A1 | 12/2002 |
| EP | 1584486 | A1 | 10/2005 |
| JP | 2008-168440 | A | 7/2008 |

OTHER PUBLICATIONS

Europe Patent Office, "Search Report for EP 15178949.2," Dec. 14, 2015.

*Primary Examiner* — Leslie A Nicholson, III
(74) *Attorney, Agent, or Firm* — Manabu Kanesaka

(57) ABSTRACT

A bookbinding system shapes a booklet in such a manner that a paper sheet bundle composed of plural text paper sheets is bound by case binding using a cover paper sheet. In this case, a paper sheet having a size fitting within a region configured with a front surface, a back surface, and a spine of the paper sheet bundle is used as the cover paper sheet. For example, vertically-long A4 paper sheets are used as the text paper sheets, and a horizontally-long A3 paper sheet is used as the cover paper sheet to carry out case bookbinding. The cover paper sheet does not protrude from the outer shape of the paper sheet bundle. Thus, it is not necessary to cut the cover paper sheet, and no cutting waste is generated.

6 Claims, 14 Drawing Sheets

(56) References Cited

U.S. PATENT DOCUMENTS

| | | | | |
|---|---|---|---|---|
| 7,957,024 | B2 * | 6/2011 | Tokashiki | B42C 19/02 358/1.13 |
| 8,395,806 | B2 * | 3/2013 | Kusakabe | B42C 7/00 358/1.15 |
| 9,061,538 | B2 * | 6/2015 | Nagasawa | B42C 9/0037 |
| 9,067,453 | B2 * | 6/2015 | Wiegand | B42C 19/00 |
| 9,132,688 | B2 * | 9/2015 | Ota | B42C 9/0006 |
| 9,229,956 | B2 * | 1/2016 | Ke | G06F 17/30277 |
| 2013/0280015 | A1 * | 10/2013 | Enomoto | B42C 11/04 412/11 |
| 2014/0064882 | A1 * | 3/2014 | Sato | B42C 11/04 412/19 |
| 2014/0294538 | A1 * | 10/2014 | Kimura | B42C 1/12 412/13 |

* cited by examiner

COVER PAPER SHEET P2

TEXT PAPER SHEET 2N

COVER PAPER SHEET P2

TEXT PAPER SHEET 2N

COVER PAPER SHEET P2

TEXT PAPER SHEET 2N

TEXT PAPER SHEET 2N

BOOKBINDING APPARATUS

RELATED APPLICATIONS

The present application is based on, and claims priority from, Japanese Application No. JP2014-163784 filed Aug. 11, 2014, the disclosure of which is hereby incorporated by reference herein in its entirety.

TECHNICAL FIELD

The present invention relates to a bookbinding apparatus that shapes a booklet by binding a paper sheet bundle composed of plural text paper sheets using a cover paper sheet by case binding, and particularly to a bookbinding apparatus that can shape a booklet without cutting paper sheets while using no dedicated paper sheet for a cover paper sheet.

BACKGROUND OF ART

The invention disclosed in Japanese Unexamined Patent Application Publication No. 2008-168440 relates to a bookbinding system in which an image forming apparatus is connected to a bookbinding device that carries out a bookbinding operation including a cutting process. The bookbinding system includes: a size obtaining unit (S101) that obtains the size of a completed bound book; an allowable range obtaining unit (S103) that obtains the allowable range of a cutting width in which a cutting process can be performed on the basis of the obtained size of the completed bound book; and paper sheet selection devices (S104 and S105) that determine the size of paper sheets that can be cut on the basis of the size of the completed bound book and the allowable range obtained by the aforementioned units to select a paper feeding tray. According to the bookbinding system, printing and bookbinding can be executed while selecting paper sheets with an appropriate size in accordance with the size of the paper sheets of the completed bound book.

SUMMARY OF INVENTION

Technical Problem

In the bookbinding system including a cutting process disclosed in Japanese Unexamined Patent Application Publication No. 2008-168440, the size of the paper sheets that can be cut is determined on the basis of the finial size designated by a user and the allowable range of the cutting width in which the cutting process corresponding to the finial size can be performed, an appropriate paper feeding tray having paper sheets with a size that can be cut is selected, and printed paper sheets are output. The paper feeding trays are automatically selected for middle paper sheets and covers, a middle paper sheet bundle and a cover necessary for a bookbinding process are printed, and the printed middle paper sheet bundle and the cover are bound online or offline.

According to such a bookbinding system, while the dimension (thickness of the paper sheet bundle) of the spine of the paper sheet bundle is taken into account in addition to the size of text paper sheets configuring the paper sheet bundle, the size of the cover paper sheet binding the paper sheet bundle is automatically selected. However, there is a case where a special paper sheet larger than a regular paper sheet in size is necessary as the cover paper sheet binding the paper sheet bundle depending on the size and thickness of the paper sheet bundle. Therefore, in order to adapt to the paper sheet bundles with various sizes, it has been necessary for a user to prepare large-size dedicated cover paper sheets in advance to manage the stock. If only cover paper sheets with limited sizes are used without using the large-size dedicated cover paper sheets in order to avoid such complication, it is disadvantageously necessary to accordingly reduce the size of the text paper sheets configuring the paper sheet bundle. Further, the paper sheets need to be cut in such a conventional bookbinding system. Thus, there are problems that the final size becomes smaller than the regular size and a large amount of cutting waste is generated.

The present invention has been made in view of the above-described conventional technique and the problem thereof, and an object of the present invention is to provide a bookbinding apparatus that shapes a booklet by binding a paper sheet bundle using a cover paper sheet by case binding, in particular, a bookbinding apparatus that can shape a booklet without cutting paper sheets while using no dedicated paper sheet for a cover paper sheet.

Solution to Problem

According to a first aspect of the present invention, there is provided a bookbinding system including: at least one paper feeding tray that stores paper sheets; a paper sheet bundle production unit that uses the paper sheets supplied from the paper feeding tray as text paper sheets to produce a paper sheet bundle composed of the plural text paper sheets; a shaping unit that uses the paper sheet supplied from the paper feeding tray as a cover paper sheet, contacts a spine of the paper sheet bundle and the cover paper sheet with each other, and shapes a booklet by binding the paper sheet bundle using the cover paper sheet by case binding; and a control unit that selects the paper feeding tray storing paper sheets having a size fitting within a region configured with a front surface, a back surface, and the spine of the paper sheet bundle, and allows the shaping unit to shape the booklet using the paper sheet stored in the paper feeding tray as the cover paper sheet.

According to a second aspect of the present invention, the control unit selects the paper feeding tray storing paper sheets whose length in the longitudinal or lateral direction matches the length in the direction orthogonal to the thickness direction at the spine of the paper sheet bundle when allowing the shaping unit to shape the booklet in the bookbinding system described in the first aspect of the present invention.

According to a third aspect of the present invention, the control unit controls the shaping unit to adjust the relative arrangement of the paper sheet bundle and the cover paper sheet, so that the area of a region covered with the cover paper sheet on the front surface of the paper sheet bundle is equal to or larger than the area of a region covered with the cover paper sheet on the back surface of the paper sheet bundle in the bookbinding system described in the second aspect of the present invention.

According to a fourth aspect of the present invention, the control unit controls the shaping unit to adjust the relative arrangement of the paper sheet bundle and the cover paper sheet, so that the case binding is carried out while allowing an edge of the front part of the cover paper sheet and an edge of the front surface of the paper sheet bundle to match each other in the bookbinding system described in the third aspect of the present invention.

According to a fifth aspect of the present invention, the control unit controls in such a manner that in the case where there is a printed image on the final page of the paper sheet bundle, the paper sheet bundle is formed by adding one text paper sheet to the next of the final page in the bookbinding system described in the fourth aspect of the present invention.

According to a sixth aspect of the present invention, the control unit controls in such a manner that in the case where there is a printed image on the final page of the paper sheet bundle, one text paper sheet is added only when at least a part of the printed image on the final page is exposed as a result of comparison between the printed region of the printed image on the final page and the covered region of the final page covered with the back part of the cover paper sheet in the bookbinding system described in the fifth aspect of the present invention.

Advantageous Effects of Invention

According to the bookbinding system described in the first aspect of the present invention, regardless of the types of paper sheets, a paper sheet having a size that cannot cover the entire surfaces of, at least, the front surface, the back surface, and the spine of the paper sheet bundle is selected as the cover paper sheet which is used for case binding, and the booklet can be shaped without cutting the paper sheets.

According to the bookbinding system described in the second aspect of the present invention, when the booklet is shaped in the shaping unit, a paper sheet whose length in the longitudinal or lateral direction matches the length of the rear surface orthogonal to the thickness direction of the paper sheet bundle is selected and used as the cover paper sheet. Thus, the entire surface of the spine of the paper sheet bundle can be completely covered with the cover paper sheet. Therefore, the robustness of the completed booklet is enhanced, and good appearance can be advantageously obtained.

According to the bookbinding system described in the third aspect of the present invention, in the process of binding the paper sheet bundle using the cover paper sheet by case binding, the area of the cover paper sheet covering the front surface of the paper sheet bundle can be appropriately set equal to or larger than the area of the cover paper sheet covering the back surface of the paper sheet bundle. Accordingly, in the case where it is not necessary to completely cover the front surface on the basis of the states of a range where an image is printed on the front surface (the first page of the booklet) of the paper sheet bundle or a margin where no image is printed, the part of the cover paper sheet for the front surface of the paper sheet bundle is appropriately reduced, and can be used for the back surface if necessary. Thus, the convenience can be improved when producing the booklet.

According to the bookbinding system described in the fourth aspect of the present invention, the paper sheet bundle can be bound by case binding using the cover paper sheet while allowing an edge of the front part of the cover paper sheet and an edge of the front surface of the paper sheet bundle to match each other. For example, in the case where the paper sheet bundle is produced using the vertically-long A4 text paper sheets and is bound using the horizontally-long A3 cover paper sheet, the case binding is carried out while allowing an edge of the front part of the cover paper sheet and an edge of the front surface of the paper sheet bundle to be aligned to each other. Accordingly, the entire surfaces of the front surface of the paper sheet bundle and the spine corresponding to the thickness of the paper sheet bundle can be covered with the cover paper sheet. A part of the back surface of the paper sheet bundle is not covered in accordance with the thickness of the paper sheet bundle. However, the back surface is on the inconspicuous side as compared to the front surface, and the uncovered part is not a problem depending on the intended use of the booklet. The same is true of a case where the paper sheet bundle is produced using the vertically-long B5 text paper sheets and is bound by case bookbinding using the horizontally-long B4 cover paper sheet. Further, for example, in the case where the paper sheet bundle is produced using the vertically-long A4 text paper sheets and is bound using the horizontally-long B4 cover paper sheet, the case binding is carried out while allowing an edge of the front part of the cover paper sheet and an edge of the front surface of the paper sheet bundle to be aligned to each other. Although the entire surfaces of the front surface of the paper sheet bundle and the spine corresponding to the thickness of the paper sheet bundle cannot be covered with the cover paper sheet, the edge of the front part of the cover paper sheet and the edge of the front surface of the paper sheet bundle are aligned to each other, and thus a sense of discomfort of the exterior can be reduced. In addition, the booklet can be used without any problems depending on the intended use of the booklet.

According to the bookbinding system described in the fifth aspect of the present invention, in the case where there is a printed image on the final page of the paper sheet bundle, one text paper sheet is added to the next of the final page to form the paper sheet bundle. A part of the back surface of the paper sheet bundle cannot be covered with the cover paper sheet in accordance with the thickness of the paper sheet bundle. Thus, even if there is a printed image on the final page at a position that is not covered with the cover paper sheet, the printed image is covered with the added text paper sheet, and thus is not exposed. In addition, it is unlikely that the image is stained due to friction against foreign substances or the like.

According to the bookbinding system described in the sixth aspect of the present invention, in the case where there is a printed image on the final page of the paper sheet bundle, the printed region of the printed image on the final page is compared to the covered region where the back part of the cover paper sheet covers the final page. Only when at least a part of the printed image on the final page is exposed, one text paper sheet is added. Even if a part of the back surface of the paper sheet bundle cannot be covered with the cover paper sheet in accordance with the thickness of the paper sheet bundle and there is a printed image on the final page, no text paper sheet is added unless the printed image on the final page is actually exposed without being covered with the cover paper sheet. Thus, no text paper sheet is wastefully added to protect the printed image on the final page.

DESCRIPTION OF EMBODIMENTS

Figure 1:
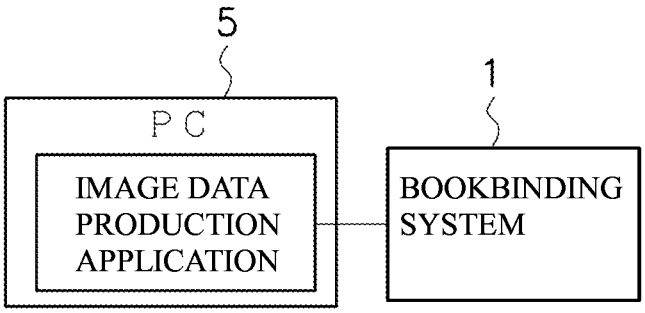
FIG. 1 is a schematic configuration diagram of a bookbinding system and an external PC according to an embodiment.

An embodiment of the present invention will be described with reference to the drawings. The same or equivalent parts and constitutional elements are given the same or equivalent reference numerals throughout the all drawings. It should be noted that the drawings are schematically illustrated, and are different from the actual parts and constitutional elements. Further, it is obvious that the mutual relations of dimensions and ratios are partially different among the drawings.

Further, the embodiment shown below exemplifies an apparatus and the like to embody technical ideas of the present invention, and the technical ideas of the present invention do not limit the arrangement and the like of each constitutional part to those shown below. The technical ideas of the present invention can be variously changed in claims.

Figure 2:
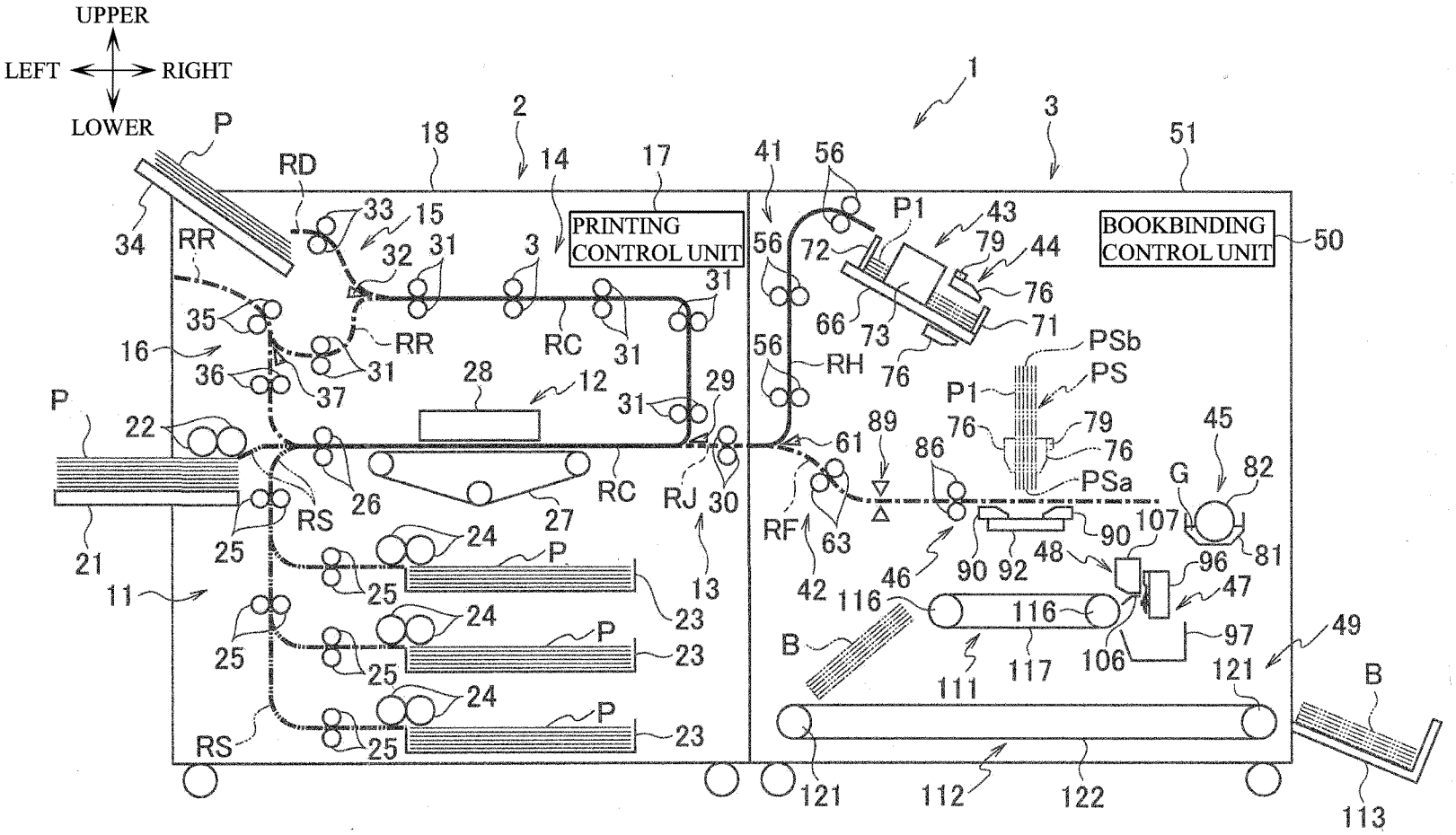
FIG. 2 is a schematic configuration diagram of the bookbinding system according to the embodiment.
Figure 3:
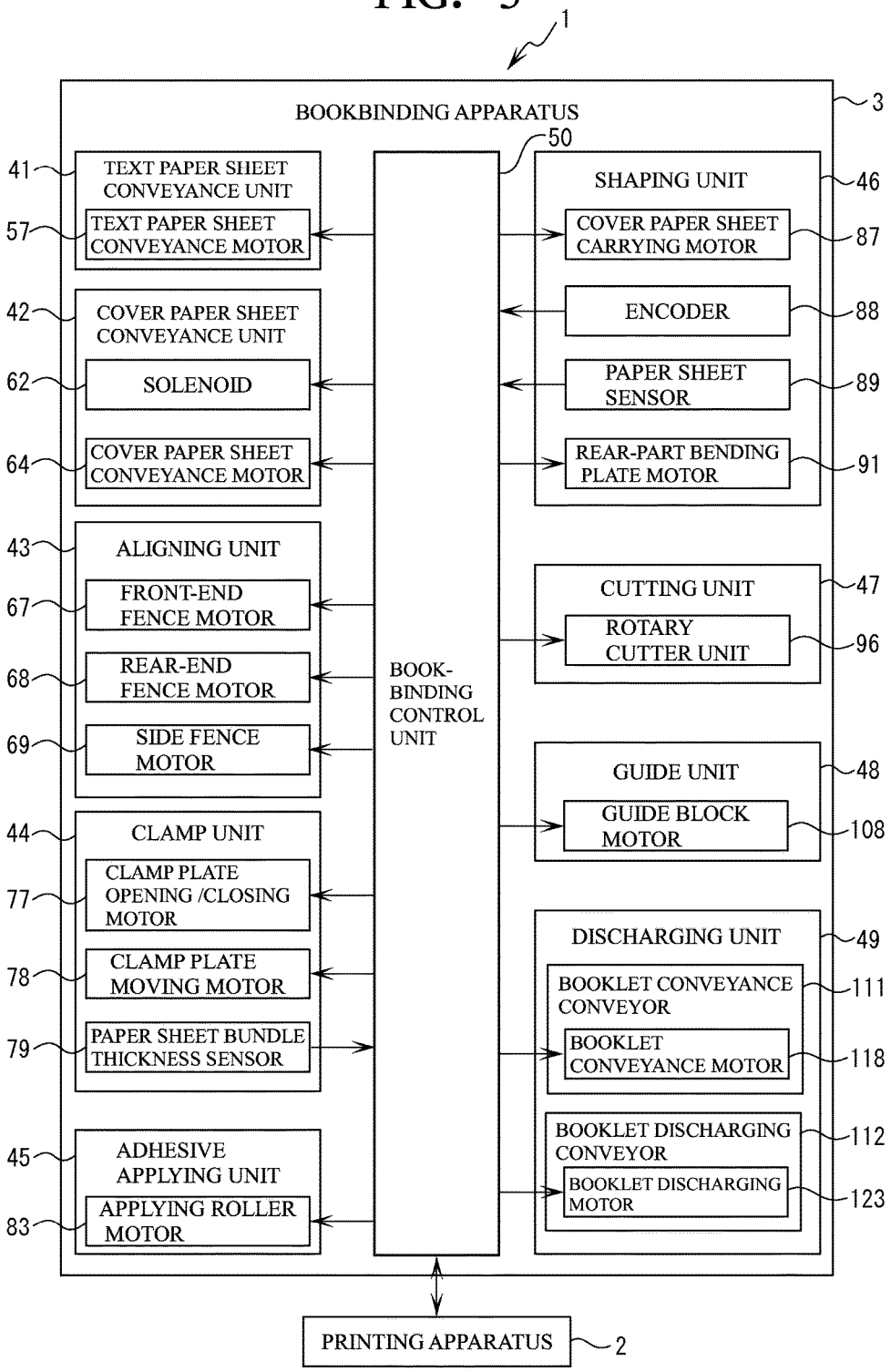
FIG. 3 is a control block diagram of the bookbinding system shown in FIG. 1.

FIG. 1 is a schematic configuration diagram of a bookbinding system according to an embodiment and a PC provided outside the bookbinding system. FIG. 2 is a schematic configuration diagram of the bookbinding system according to the embodiment of the present invention. FIG. 3 is a control block diagram of the bookbinding system shown in FIG. 1. In the following description, the front direction of FIG. 2 where a user is located is defined as a front. Further, "upper", "lower", "left", and "right" viewed from the user are defined as upper, lower, left, and right directions, respectively, as shown in FIG. 2.

As shown in FIG. 1, the bookbinding system 1 according to the embodiment is connected to an external PC 5 (personal computer).

Applications for editing image data are installed in the PC 5. The PC 5 can allocate and edit images to be printed on text paper sheets and a cover paper sheet of a booklet, and can supply the same to the bookbinding system 1. Further, the bookbinding system 1 of the embodiment can form necessary images on text paper sheets (front and back) and a cover paper sheet (front cover and back cover) on the basis of the image data obtained from the PC 5. Further, the bookbinding system 1 produces a paper sheet bundle using plural text paper sheets on which images are formed, and the paper sheet bundle can be bound by case binding using the cover paper sheet on which images are formed to shape a booklet.

The bookbinding system 1 according to the embodiment can carry out a bookbinding operation (for convenience sake, referred to as a normal bookbinding operation) in which a paper sheet bundle is produced using regular paper sheets defined in a standard as text paper sheets, case bookbinding is carried out using a large-size dedicated cover paper sheet, and a surplus cover paper sheet are cut and removed. However, the bookbinding system 1 can particularly carry out a bookbinding operation (for convenience sake, referred to as a special bookbinding operation) in which regular paper sheets or irregular paper sheets of another kind are used for text paper sheets and a cover paper sheet, and a booklet is shaped without cutting the paper sheets.

The special bookbinding operation means a bookbinding mode in which a paper sheet bundle PS is produced using regular paper sheets or irregular paper sheets of an arbitrary kind, a regular paper sheet or an irregular paper sheet having a size fitting within a region configured with the front surface, the back surface, and the rear-side end surface (hereinafter referred to as "spine") of the paper sheet bundle PS, namely, a region obtained by expanding the paper sheet bundle PS on a plane surface is selected as a cover paper sheet P2, and the paper sheet bundle PS is bound by case binding using the cover paper sheet P2 to shape a booklet B. Thus, a regular paper sheet or an irregular paper sheet can be used for a cover paper sheet as long as the size of the paper sheet is smaller than the region configured with the front surface, the back surface, and the spine of the paper sheet bundle PS. According to such a bookbinding mode, the cover paper sheet P2 always covers a part of each of the front surface, the back surface, and the spine of the paper sheet bundle PS, but does not necessarily cover the entirety of each surface. However, after the case binding, a part of the cover paper sheet P2 binding the paper sheet bundle PS does not protrude outside relative to the outer shape of the paper sheet bundle PS. Thus, it is not necessary to cut the cover paper sheet.

Specifically, a printing control unit 17 and a bookbinding control unit 50 to be described later control the respective units in such a manner that a paper feeding tray storing the paper sheets that satisfy the above-described conditions is selected on the basis of an instruction by a user, designation in advance, or an automatic determination on the basis of job information, the paper sheets are fed as cover paper sheets, and a case bookbinding operation is carried out in the above-described mode.

It should be noted that in the case where, in particular, the spine of the paper sheet bundle is completely covered with the cover paper sheet in the above-described special bookbinding operation, a paper feeding tray storing paper sheets whose length in the longitudinal or lateral direction matches the length in the direction orthogonal to the thickness direction at the spine of the paper sheet bundle is selected as a paper feeding tray for feeding the cover paper sheets.

As described above, regular paper sheets or irregular paper sheets of an arbitrary kind can be used for the text paper sheets P1 and the cover paper sheet P2 as long as the above-described conditions are satisfied in the special bookbinding operation. However, in view of a point that regular paper sheets are most commonly used, an example of using regular paper sheets as the text paper sheets P1 and the cover paper sheet P2 will be briefly described. This example will also be described later in detail with reference to FIG. 13 and FIG. 14. Specifically, in the case where the paper sheet bundle PS is produced using the A4 text paper sheets P1 and is bound by case binding using the A3 cover paper sheet P2, the case binding is carried out while an edge E2 of a front part (front cover P2F) of the cover paper sheet P2 and an edge E1 of a front surface PSF of the paper sheet bundle PS are aligned to each other. Accordingly, the entire surface of each of the front surface PSF of the paper sheet bundle PS and a spine PSa corresponding to the thickness of the paper sheet bundle PS can be covered with the cover paper sheet P2. In this case, a part of a back surface PSB of the paper sheet bundle PS cannot be covered in accordance with the thickness of the paper sheet bundle PS. However, the back surface PSB is on the inconspicuous side as compared to the front surface PSF, and the uncovered part is not a problem depending on the intended use of the booklet B.

Figure 13:
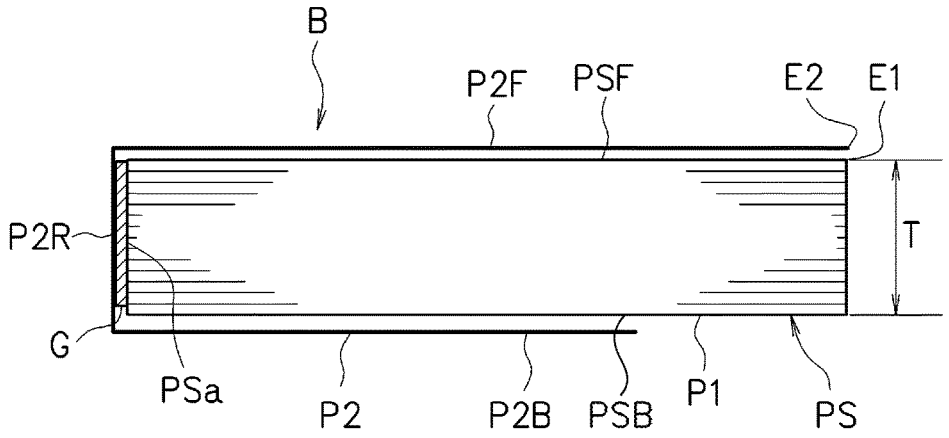
FIG. 13 is a diagram of a booklet of a first mode example that is shaped in the bookbinding system of the embodiment and is viewed from the parallel direction of the drawing.
Figure 14:
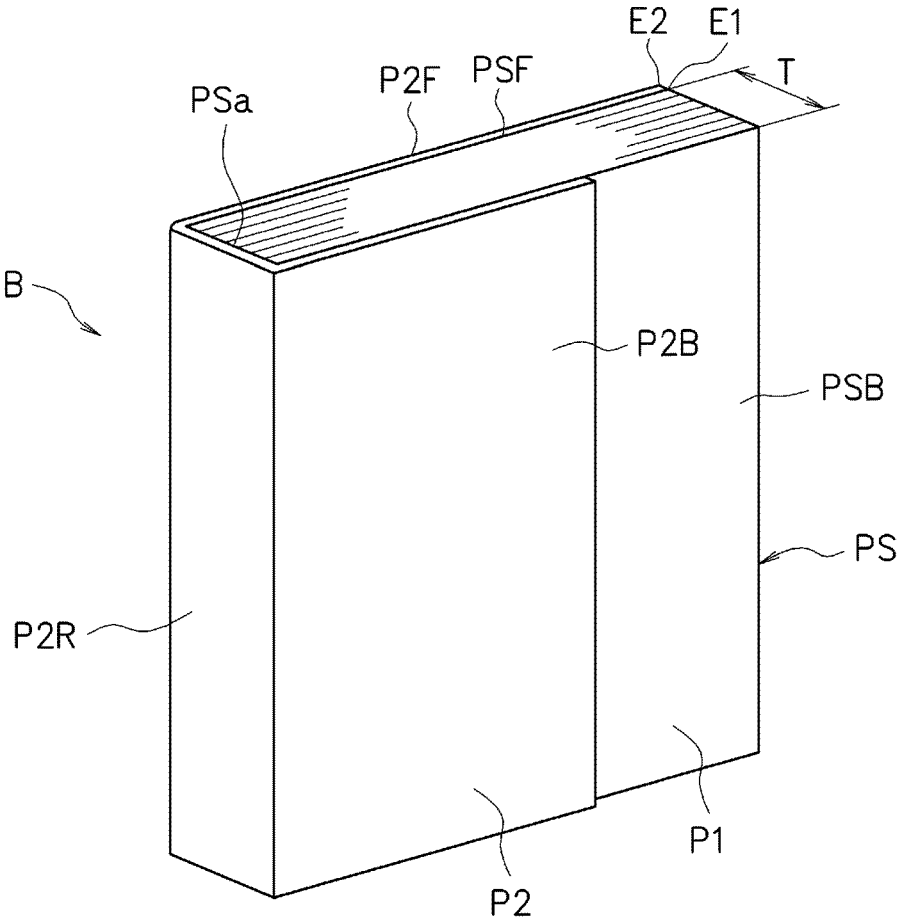
FIG. 14 is a perspective view for showing the booklet of the first mode example that is shaped in the bookbinding system of the embodiment.

It should be noted that the case binding is carried out while the edge E2 of the front part (front cover P2F) of the cover paper sheet P2 and the edge E1 of the front surface PSF of the paper sheet bundle PS are aligned to each other in the examples of FIG. 13 and FIG. 14. This process is not necessarily a prerequisite as the special bookbinding operation. For example, a mode in which a part of each of the front surface PSF and the back surface PSB of the paper sheet bundle PS cannot be covered with the cover paper sheet P2 may be employed, and will be described later as an example with reference to FIGS. 18A and 18B. Further, the embodiment includes a bookbinding mode in which the entire surface of the spine PSa of the paper sheet bundle PS is not covered with the cover sheet P2, and a part of the spine PSa is exposed.

As described above in the section of "Solution to Problem", the object of the embodiment is to solve complications when using dedicated cover paper sheets and problems of cutting wastes in a conventional bookbinding system. In the following description, a case of using the bookbinding system 1 in the special bookbinding operation will be mainly described.

As shown in FIG. 2 and FIG. 3, the bookbinding system 1 according to the embodiment includes a printing apparatus 2 and a bookbinding apparatus 3.

The printing apparatus 2 prints necessary information on paper sheets P configuring the booklet B, namely, the text paper sheets P1 configuring the paper sheet bundle PS and the cover paper sheet P2 binding the paper sheet bundle PS. The printing apparatus 2 includes a paper feeding unit 11, a printing unit 12, a relay unit 13, an upper-surface conveyance unit 14, a paper discharging unit 15, a reversing unit 16, a printing control unit 17, and a housing 18 that stores or holds the respective units.

It should be noted that the paper sheets P used for printing in the printing apparatus 2 are regular paper sheets defined in a standard when using the bookbinding system 1 in the special bookbinding operation. As will be described later in detail, for example, in the case of the ISO A series, when A4 paper sheets are used as the text paper sheets P1 in a vertically-long manner, an A3 paper sheet can be used in a horizontally-long manner as the cover paper sheet P2 binding the paper sheet bundle PS produced using the A4 text paper sheets P1. Further, for example, in the case of the JIS B series, when B5 paper sheets are used as the text paper sheets P1 in a vertically-long manner, a B4 paper sheet can be used in a horizontally-long manner as the cover paper sheet P2 binding the paper sheet bundle PS produced using the B5 text paper sheets P1. Further, regular paper sheets of the A series and B series can be used together.

The route represented by the thick line in FIG. 2 is a conveyance route in which paper sheets are conveyed. Among the conveyance routes in the printing apparatus 2, the route represented by the solid line is a normal route RC, the route represented by the dashed-dotted line is a reverse route RR, the route represented by the long dashed line is a paper discharging route RD, the route represented by the short dashed line is a relay route RJ, and the route represented by the two-dot chain line is a paper feeding route RS. The upstream and downstream sides in the following description mean those in the conveyance route.

The paper feeding unit 11 feeds paper sheets to the printing unit 12. The paper feeding unit 11 is arranged on the most upstream side of the conveyance route. The paper feeding unit 11 includes an external paper feeding base 21, external paper feeding rollers 22, plural internal paper feeding bases 23, plural pairs of internal paper feeding rollers 24, and plural pairs of internal paper feeding conveyance rollers 25. It should be noted that the external paper feeding base 21 and the internal paper feeding bases 23 are collectively referred to as a paper feeding tray in the specification.

On the external paper feeding base 21, loaded are the paper sheets P used for printing. The external paper feeding base 21 is installed while a part thereof is exposed to the outside of the housing 18.

The external paper feeding rollers 22 take out the paper sheets P one by one from the external paper feeding base 21 to be conveyed toward resist rollers 26, to be described later, along the paper feeding route RS. The external paper feeding rollers 22 are arranged above the external paper feeding base 21. The external paper feeding rollers 22 are driven by a motor (not shown).

On the internal paper feeding bases 23, loaded are the paper sheets P used for printing. The internal paper feeding bases 23 are arranged inside the housing 18.

The internal paper feeding rollers 24 take out the paper sheets P one by one from the internal paper feeding bases 23 to be sent to the paper feeding route RS. Each of the internal paper feeding rollers 24 is arranged above each of the internal paper feeding bases 23. The internal paper feeding rollers 24 are driven by a motor (not shown).

The internal paper feeding conveyance rollers 25 convey the paper sheets P taken out of the internal paper feeding bases 23 toward the resist rollers 26. The internal paper feeding conveyance rollers 25 are arranged along the paper feeding route RS. The internal paper feeding conveyance rollers 25 are driven by a motor (not shown).

The printing unit 12 prints images on the paper sheets P while conveying the paper sheets P. The printing unit 12 is arranged on the downstream side of the paper feeding unit 11. The printing unit 12 includes the resist rollers 26, a belt conveyance unit 27, and an ink-jet head unit 28.

The resist rollers 26 stop the paper sheets P conveyed from the paper feeding unit 11 or the reversing unit 16 once, and then convey the same toward the belt conveyance unit 27. The resist rollers 26 are arranged on the normal route RC near the meeting point of the paper feeding route RS and the reverse route RR. The resist rollers 26 are driven by a motor (not shown).

The belt conveyance unit 27 absorbs and holds the paper sheets P conveyed from the resist rollers 26 on the belt, and conveys the same. The belt conveyance unit 27 is arranged on the downstream side of the resist rollers 26. The belt conveyance unit 27 is driven by a motor (not shown).

The ink-jet head unit 28 includes plural line-type ink-jet heads (not shown) in which plural nozzles are aligned in the direction (front-rear direction) substantially orthogonal to the conveyance direction of the paper sheets P. The ink-jet head unit 28 is arranged above the belt conveyance unit 27. The ink-jet head unit 28 prints images on the paper sheets P conveyed by the belt conveyance unit 27 while discharging an ink from the ink-jet heads.

The relay unit 13 sends the printed paper sheets P to the bookbinding apparatus 3 at the time of printing for bookbinding. The relay unit 13 includes a switch unit 29 and relay rollers 30.

The switch unit 29 switches the conveyance route of the paper sheets P between the normal route RC and the relay route RJ. The switch unit 29 is arranged at the branch point of the normal route RC and the relay route RJ. The switch unit 29 is driven by a solenoid (not shown). The relay route RJ is a route extending toward the bookbinding apparatus 3 from the boundary between the printing unit 12 and the upper-surface conveyance unit 14. The downstream end of the relay route RJ is connected to the upstream end of a text paper sheet route RH of the bookbinding apparatus 3 to be described later.

The relay rollers 30 convey the paper sheets P conveyed from the belt conveyance unit 27, and send the same to the bookbinding apparatus 3. The relay rollers 30 are arranged on the downstream side of the switch unit 29 along the relay route RJ. The relay rollers 30 are driven by a motor (not shown).

The upper-surface conveyance unit 14 conveys the paper sheets P conveyed by the belt conveyance unit 27 so as to make a U-turn from the right direction to the left direction. The upper-surface conveyance unit 14 includes plural pairs of upper-surface conveyance rollers 31.

The upper-surface conveyance rollers 31 convey the paper sheets P in an NIP method. The upper-surface conveyance rollers 31 on the most downstream side are arranged at an upstream part of the reverse route RR. The other upper-surface conveyance rollers 31 are arranged along the normal route RC between the printing unit 12 and the paper discharging unit 15. The upper-surface conveyance rollers 31 are driven by a motor (not shown).

The paper discharging unit 15 discharges the printed paper sheets P. The paper discharging unit 15 includes a switch unit 32, paper discharging rollers 33, and a paper discharging base 34.

The switch unit 32 switches the conveyance route of the paper sheets P between the paper discharging route RD and the reverse route RR. The switch unit 32 is arranged at the branch point of the paper discharging route RD and the reverse route RR. The switch unit 32 is driven by a solenoid (not shown).

The paper discharging rollers 33 convey the paper sheets P conveyed by the upper-surface conveyance unit 14, and discharge the same to the paper discharging base 34. The paper discharging rollers 33 are arranged between the switch unit 32 and the paper discharging base 34 along the paper discharging route RD. The paper discharging rollers 33 are driven by a motor (not shown).

On the paper discharging base 34, loaded are the discharged paper sheets P. The paper discharging base 34 is arranged at the downstream end of the paper discharging route RD.

The reversing unit 16 reverses the single-side printed paper sheets P, and conveys the same to the resist rollers 26 at the time of double-side printing. The reversing unit 16 includes reverse rollers 35, paper re-feeding rollers 36, and a switch gate 37.

The reverse rollers 35 switch back the paper sheets P conveyed by the upper-surface conveyance unit 14, and convey the same to the paper re-feeding rollers 36. The reverse rollers 35 are arranged along the reverse route RR between the upper-surface conveyance rollers 31 on the most downstream side and the paper re-feeding rollers 36. The reverse rollers 35 are driven by a motor (not shown).

The paper re-feeding rollers 36 convey the paper sheets P conveyed by the reverse rollers 35 to the resist rollers 26. The paper re-feeding rollers 36 are arranged on the reverse route RR between the reverse rollers 35 and the resist rollers 26. The paper re-feeding rollers 36 are driven by a motor (not shown).

The switch gate 37 guides the paper sheets P conveyed by the upper-surface conveyance rollers 31 to the reverse rollers 35. Further, the switch gate 37 guides the paper sheets P switched back by the reverse rollers 35 to the paper re-feeding rollers 36. The switch gate 37 is arranged near the center of gravity of the three positions of the upper-surface conveyance rollers 31 on the most downstream side, the reverse rollers 35, and the paper re-feeding rollers 36.

The printing control unit 17 controls operations of the respective units of the printing apparatus 2. The printing control unit 17 is configured using a CPU, a RAM, a ROM, a hard disk, and the like. The printing control unit 17 corresponds to a part of the control unit described in claims.

Although the details of the functions and effects of the printing control unit 17 will be described later, the printing control unit 17 has a function of selecting a paper feeding tray storing the cover paper sheets P2 suitable for the special bookbinding operation in cooperation with the bookbinding control unit 50 to be described later.

Further, in consideration of points that the size of the back part (back cover P2B) of the cover paper sheet P2 is changed due to the thickness of a completed booklet and a part of the back surface PSB of the paper sheet bundle PS cannot be covered with the back cover P2B in the special bookbinding operation of the bookbinding system 1, the printing control unit 17 forms appropriate printed images on the final page of the text paper sheets P1 or the back cover P2B if necessary in order to improve a deterioration in appearance. Further, in the case where image data to be printed is designated, the printing control unit 17 controls to form printed images in such a manner that the image data is edited so as to be appropriately divided, and each edited image data is allocated to appropriate positions in the text paper sheets P1 and the cover paper sheet P2. Thus, the exterior of the small back cover P2B can be made as inconspicuous as possible.

It should be noted that whether or not the above-described process such as addition or edition of the image data is performed in the special bookbinding operation or determination on what content of the process is performed if the above-described process is performed may be provided as part of job information input from the external PC 5 shown in FIG. 1, or may be input into the bookbinding control unit 50 by the user. Further, these may be determined through automatic selection by the apparatus itself.

The bookbinding apparatus 3 creates the booklet B using a case bookbinding function. The case bookbinding function is a function in which the paper sheet bundle PS composed of plural text paper sheets P1 is produced, and is bound by case binding using the cover paper sheet P2 to shape the booklet B. It should be noted that the bookbinding apparatus 3 can selectively carry out the normal bookbinding operation and the special bookbinding operation as described above. The bookbinding apparatus 3 includes a text paper sheet conveyance unit 41, a cover paper sheet conveyance unit 42, an aligning unit 43, a clamp unit 44, an adhesive applying unit 45, a shaping unit 46, a cutting unit 47, a guide unit 48, a discharging unit 49, the bookbinding control unit 50, and a housing 51 that stores or holds the respective units.

It should be noted that the route represented by the solid line is the text paper sheet route RH and the route represented by the dashed-dotted line is a cover paper sheet route RF among the conveyance routes in the bookbinding apparatus 3.

The text paper sheet conveyance unit 41 conveys the printed text paper sheets P1 sent from the printing apparatus 2 to the aligning unit 43. The text paper sheet conveyance unit 41 includes plural pairs of text paper sheet conveyance rollers 56 and a text paper sheet conveyance motor 57.

The text paper sheet conveyance rollers 56 convey the text paper sheets P1 sent from the printing apparatus 2 in an NIP method. The text paper sheet conveyance rollers 56 are arranged along the text paper sheet route RH. The upstream end of the text paper sheet route RH is connected to the downstream end of the relay route RJ of the printing apparatus 2.

The text paper sheet conveyance motor 57 rotatably drives plural pairs of text paper sheet conveyance rollers 56.

The cover paper sheet conveyance unit 42 conveys the printed cover paper sheet P2 sent from the printing apparatus 2 to the shaping unit 46. The cover paper sheet conveyance unit 42 includes a switch unit 61, a solenoid 62, cover paper sheet conveyance rollers 63, and a cover paper sheet conveyance motor 64.

The switch unit 61 switches the conveyance route of the paper sheets P (the text paper sheets P1 and cover paper sheet P2) between the text paper sheet route RH and the cover paper sheet route RF. The switch unit 61 is arranged at the branch point of the text paper sheet route RH and the cover paper sheet route RF.

The solenoid 62 drives the switch unit 61.

The cover paper sheet conveyance rollers 63 convey the cover paper sheet P2 sent from the printing apparatus 2 in an NIP method. The cover paper sheet conveyance rollers 63 are arranged at an upstream part of the cover paper sheet route RF.

The cover paper sheet conveyance motor 64 rotatably drives the cover paper sheet conveyance rollers 63.

The aligning unit 43 functions as a paper sheet bundle production unit that aligns the plural printed text paper sheets P1 to produce a paper sheet bundle composed of the plural text paper sheets P1. The aligning unit 43 includes an aligning tray 66, a front-end fence motor 67, a rear-end fence motor 68, and a side fence motor 69.

On the aligning tray 66, loaded are the text paper sheets P1. A front-end fence 71, a rear-end fence 72, and a pair of side fences 73 stand on the aligning tray 66. The front-end fence 71 regulates the position of the text paper sheets P1 on the front-end side in the conveyance direction. The rear-end fence 72 regulates the position of the text paper sheets P1 on the rear-end side in the conveyance direction. The pair of side fences 73 regulates the position of the text paper sheets P1 in the direction (front-rear direction) orthogonal to the conveyance direction. The front-end fence 71 and the rear-end fence 72 can be moved in parallel to the paper sheet conveyance direction. The pair of side fences 73 can be moved close to or apart from each other in the front-rear direction.

The front-end fence motor 67 moves the front-end fence 71. The rear-end fence motor 68 moves the rear-end fence 72. The side fence motor 69 moves the side fences 73.

The clamp unit 44 clamps the paper sheet bundle PS composed of the plural text paper sheets P1 loaded on the aligning tray 66, and moves the clamped paper sheet bundle PS. The clamp unit 44 includes a pair of clamp plates 76, a clamp plate opening/closing motor 77, a clamp plate moving motor 78, and a paper sheet bundle thickness sensor 79.

The pair of clamp plates 76 clamp (sandwich) the paper sheet bundle PS loaded on the aligning tray 66. The pair of clamp plates 76 are opened and closed to clamp the paper sheet bundle PS or release the clamping. The pair of clamp plates 76 move the clamped paper sheet bundle PS to the adhesive applying unit 45, the shaping unit 46, or the like.

The clamp plate opening/closing motor 77 opens and closes the pair of clamp plates 76.

The clamp plate moving motor 78 moves the pair of clamp plates 76. Accordingly, the pair of clamp plates 76 can be moved to the adhesive applying unit 45, the shaping unit 46, or the like.

The paper sheet bundle thickness sensor 79 measures the thickness of the paper sheet bundle PS. The paper sheet bundle thickness sensor 79 is installed on the clamp plates 76. The paper sheet bundle thickness sensor 79 measures the thickness of the paper sheet bundle PS on the basis of the moving distances of the clamp plates 76 when the pair of clamp plates 76 clamp the paper sheet bundle PS.

The adhesive applying unit 45 applies a hot-melt adhesive onto the spine PSa of the paper sheet bundle PS. The adhesive applying unit 45 is arranged on the right side of the shaping unit 46. The adhesive applying unit 45 includes an adhesive housing unit 81, an applying roller 82, and an applying roller motor 83.

The adhesive housing unit 81 houses the hot-melt adhesive G. The hot-melt adhesive G allows the paper sheet bundle PS and the cover paper sheet P2 to adhere to each other.

The applying roller 82 attaches the hot-melt adhesive G housed in the adhesive housing unit 81 to the outer peripheral surface. The paper sheet bundle PS is brought into contact with the applying roller 82, so that the hot-melt adhesive G attached to the outer peripheral surface of the applying roller 82 is attached to the paper sheet bundle PS.

The applying roller motor 83 rotates the applying roller 82. Accordingly, the applying roller 82 can be rotated in the hot-melt adhesive G housed in the adhesive housing unit 81, the hot-melt adhesive G is attached to the outer peripheral surface of the applying roller 82 to be drawn and exposed from the adhesive housing unit 81, and the hot-melt adhesive G can be applied to the spine PSa of the paper sheet bundle PS contacted with the outer peripheral surface.

The shaping unit 46 shapes the booklet B in such a manner that the paper sheet bundle PS composed of regular paper sheets is bound by case binding using the cover paper sheet P2 of a regular paper sheet in the special bookbinding operation. In this case, the shaping unit 46 binds the paper sheet bundle PS using the cover paper sheet P2 while an edge of the front part of the cover paper sheet P2 and an edge of the front surface of the paper sheet bundle PS are aligned to each other, so that the entire surfaces of the front surface and the spine of the paper sheet bundle PS can be covered with the cover paper sheet P2. This case binding will be described later. The shaping unit 46 is arranged under the aligning tray 66.

The shaping unit 46 includes cover paper sheet carrying rollers 86, a cover paper sheet carrying motor 87, an encoder 88, a paper sheet sensor 89, a pair of rear-part bending plates 90, a rear-part bending plate motor 91, and an abutting plate 92.

The cover paper sheet carrying rollers 86 convey the cover paper sheet P2 conveyed by the cover paper sheet conveyance rollers 63 of the cover paper sheet conveyance unit 42 in an NIP method, and arrange the cover paper sheet P2 on the pair of rear-part bending plates 90. The cover paper sheet carrying rollers 86 are arranged near the upstream side of the pair of rear-part bending plates 90 on the downstream side of the cover paper sheet conveyance rollers 63. The cover paper sheet carrying rollers 86 can release the NIP of the cover paper sheet P2.

The cover paper sheet carrying motor 87 rotatably drives the cover paper sheet carrying rollers 86.

The encoder 88 detects the rotational angle of the rotational shaft of the cover paper sheet carrying motor 87, and generates a pulse signal in accordance with the rotational angle.

The paper sheet sensor 89 detects the cover paper sheet P2 conveyed on the cover paper sheet route RF. The paper sheet sensor 89 is arranged between the cover paper sheet conveyance rollers 63 and the cover paper sheet carrying rollers 86.

The pair of rear-part bending plates 90 bends the boundary part between the spine and the front cover of the cover paper sheet P2, and the boundary part between the spine and the back cover. The pair of rear-part bending plates 90 can be moved in the right-left direction so as to be close to or apart from each other. The rear-part bending plates 90 are arranged on the abutting plate 92.

The spine PSa of the paper sheet bundle PS abuts on the abutting plate 92 through the cover paper sheet P2.

The cutting unit 47 can cut the cover paper sheet P2 if necessary. The cutting unit 47 is arranged on the lower right side of the shaping unit 46. The cutting unit 47 includes a rotary cutter unit 96 that cuts a surplus cover paper sheet protruding from an edge of the paper sheet bundle produced by the shaping unit 46 in the special bookbinding operation, and a waste holder 97 that receives cutting pieces of the cover paper sheet P2 cut by the rotary cutter unit 96.

The cutting unit 47 is used in the case of the above-described normal bookbinding operation. Specifically, the cutting unit 47 is used in the case where the paper sheet bundle PS of regular paper sheets is produced, the paper sheet bundle PS is bound using a large-size dedicated cover paper sheet, and a surplus cover paper sheet protruding from an edge of the paper sheet bundle PS is cut and removed. The cutting unit 47 is not used in the special bookbinding operation to be described in detail in the embodiment, namely, a bookbinding operation in which only regular paper sheets are used for the text paper sheets P1 and the cover paper sheet P2, and the booklet B is shaped without cutting the paper sheets.

The guide unit 48 guides toward the rotary cutter unit 96 an end part of the cover paper sheet P2, to be cut, of the booklet B conveyed toward the cutting unit 47 by a booklet conveyance conveyor 111 to be described later. The guide unit 48 is arranged on the left side of the cutting unit 47 while being adjacent thereto. The guide unit 48 includes a guide plate 106, a guide block 107, and a guide block motor 108. The guide block motor 108 moves the guide block 107 in the vertical direction.

The discharging unit 49 discharges the completed booklet B to the outside of the housing 51. The discharging unit 49 is arranged on the lower side of the bookbinding apparatus 3. The discharging unit 49 includes the booklet conveyance conveyor 111, a booklet discharging conveyor 112, and a receiving base 113.

The booklet conveyance conveyor 111 receives the booklet B shaped by the shaping unit 46, and conveys the booklet B to the cutting unit 47 in the case of the normal bookbinding operation. When the cutting of the cover paper sheet P2 by the cutting unit 47 is finished, the booklet conveyance conveyor 111 conveys the completed booklet B in the left direction to be dropped onto the booklet discharging conveyor 112. In the case of the special bookbinding operation, the booklet conveyance conveyor 111 conveys the completed booklet B in the left direction to be dropped onto the booklet discharging conveyor 112. The booklet conveyance conveyor 111 is arranged on the left side of the guide unit 48 under the shaping unit 46.

The booklet conveyance conveyor 111 includes a pair of pulleys 116, a conveyance belt 117, and a booklet conveyance motor 118.

The conveyance belt 117 is provided across the pair of pulleys 116 to rotate the conveyance belt 117.

The conveyance belt 117 is a circular belt provided across the pair of pulleys 116. The conveyance belt 117 is endlessly moved by the rotation of the pulleys 116 to convey the booklet B.

The booklet conveyance motor 118 rotatably drives one of the pair of pulleys 116. The other pulley 116 is driven by the one pulley 116 through the conveyance belt 117.

The booklet discharging conveyor 112 receives the booklet B from the booklet conveyance conveyor 111, and conveys the same to the right direction to be discharged to the receiving base 113. The booklet discharging conveyor 112 is arranged under the booklet conveyance conveyor 111. The booklet discharging conveyor 112 is longer than the booklet conveyance conveyor 111 in the right-left direction, and almost completely extends in the housing 51 in the right-left direction. The booklet discharging conveyor 112 includes a pair of pulleys 121, a conveyance belt 122, and a booklet discharging motor 123.

The conveyance belt 122 is provided across the pair of pulleys 121 to rotate the conveyance belt 122.

The conveyance belt 122 is a circular belt provided across the pair of pulleys 121. The conveyance belt 122 is endlessly moved by the rotation of the pulleys 121 to convey the booklet B.

The booklet discharging motor 123 rotatably drives one of the pair of pulleys 121. The other pulley 121 is driven by the one pulley 121 through the conveyance belt 122.

The receiving base 113 receives the booklet B discharged from the booklet discharging conveyor 112. The receiving base 113 is arranged outside the housing 51.

The bookbinding control unit 50 controls operations of the respective units of the bookbinding apparatus 3. The bookbinding control unit 50 is configured using a CPU, a RAM, a ROM, a hard disk, and the like. The bookbinding control unit 50 corresponds to a part of the control unit described in claims.

Although the details of the functions and effects of the bookbinding control unit 50 will be described later, the bookbinding control unit 50 has a function of selecting a paper feeding tray storing the cover paper sheets P2 suitable for the special bookbinding operation in cooperation with the above-described printing control unit 17.

Further, in the case where the special bookbinding operation in which regular paper sheets are used for the text paper sheets P1 and the cover paper sheet P2 is executed, the bookbinding control unit 50 can appropriately set the position of the cover paper sheet P2 relative to the rear-part bending plates 90 of the shaping unit 46 by using data related to the thickness of the paper sheet bundle PS obtained in the clamp unit 44, information about the type of cover paper sheet P2, and positional information of the cover paper sheet P2 obtained by the paper sheet sensor 89 in the shaping unit 46. In addition, the bookbinding control unit 50 can control to execute the necessary case bookbinding.

It should be noted that data related to the types of regular paper sheets used for the text paper sheets P1 and the cover paper sheet P2 in the special bookbinding operation may be provided as part of job information input from the external PC 5 or the like shown in FIG. 1, may be input to the bookbinding control unit 50 by the user, or may be determined by automatic selection.

Next, a basic printing operation of the printing apparatus 2 in the bookbinding system 1 will be described.

In this case, it is assumed that the text paper sheets P1 are loaded on the uppermost internal paper feeding base 23 and the cover paper sheets P2 are loaded on the external paper feeding base 21. Further, a case where a normal printed image is formed on each paper sheet in accordance with designated image information will be described herein, and the above-described edition and the like of the image information performed at the time of the special bookbinding operation will be described following a description of the effects of the special bookbinding.

When the printing apparatus 2 starts a bookbinding printing operation, the unprinted text paper sheets P1 conveyed from the uppermost internal paper feeding base 23 along the paper feeding route RS are fed to the printing unit 12. The printing unit 12 allows the resist rollers 26 to convey the text paper sheets P1 to the belt conveyance unit 27. Then, the text paper sheets P1 are printed using an ink discharged from the ink-jet head unit 28 while being conveyed by the belt conveyance unit 27.

In the case of single-side printing, the single-side printed text paper sheets P1 are guided to the relay route RJ by the switch unit 29 of the relay unit 13 while being conveyed by the belt conveyance unit 27. Further, the text paper sheets P1 are sent to the bookbinding apparatus 3 by the relay rollers 30.

In the case of double-side printing, the single-side printed text paper sheets P1 are guided to the upper-surface conveyance unit 14 by the switch unit 29 of the relay unit 13 while being conveyed by the belt conveyance unit 27. The text paper sheets P1 are conveyed by the upper-surface conveyance rollers 31 of the upper-surface conveyance unit 14, and are guided to the reverse route RR by the switch unit 32 of the paper discharging unit 15. The reversing unit 16 allows the switch gate 37 to guide the text paper sheets P1 to the reverse rollers 35, and the text paper sheets P1 are switched back by the reverse rollers 35. Thereafter, the text paper sheets P1 are guided to the paper re-feeding rollers 36 by the switch gate 37, and are fed to the printing unit 12 again by the paper re-feeding rollers 36. The printing unit 12 allows the resist rollers 26 to convey the text paper sheets P1 to the belt conveyance unit 27. In this case, the text paper sheets P1 are reversed by the reversing unit 16, and thus the unprinted surface faces the ink-jet head unit 28. The unprinted surfaces of the text paper sheets P1 are printed using an ink discharged from the ink-jet head unit 28 while being conveyed by the belt conveyance unit 27. The double-side printed text paper sheets P1 are sent to the bookbinding apparatus 3 from the relay unit 13 as similar to the above-described case of the single-side printing.

In the printing apparatus 2, plural text paper sheets P1 for one booklet are sequentially printed, and then the cover paper sheet P2 is printed. The cover paper sheet P2 is fed from the external paper feeding base 21, and the single-side printing or double-side printing is carried out for the cover paper sheet P2 as similar to the above-described case of the text paper sheets P1. Further, the printed cover paper sheet P2 is sent to the bookbinding apparatus 3 from the relay unit 13.

Next, a bookbinding operation of the bookbinding apparatus 3 in the bookbinding system 1 will be described.

A case where the bookbinding apparatus 3 carries out the special bookbinding operation will be described herein. Thus, regular paper sheets are used for both of the text paper sheets P1 and the cover paper sheet P2. As an example, A4 paper sheets are used for the text paper sheets P1, and an A3 paper sheet is used for the cover paper sheet P2. In addition, it is assumed that the A4 paper sheet bundle PS that is aligned in a vertically-long manner is bound using the horizontally-long A3 cover paper sheet P2.

Figure 4:
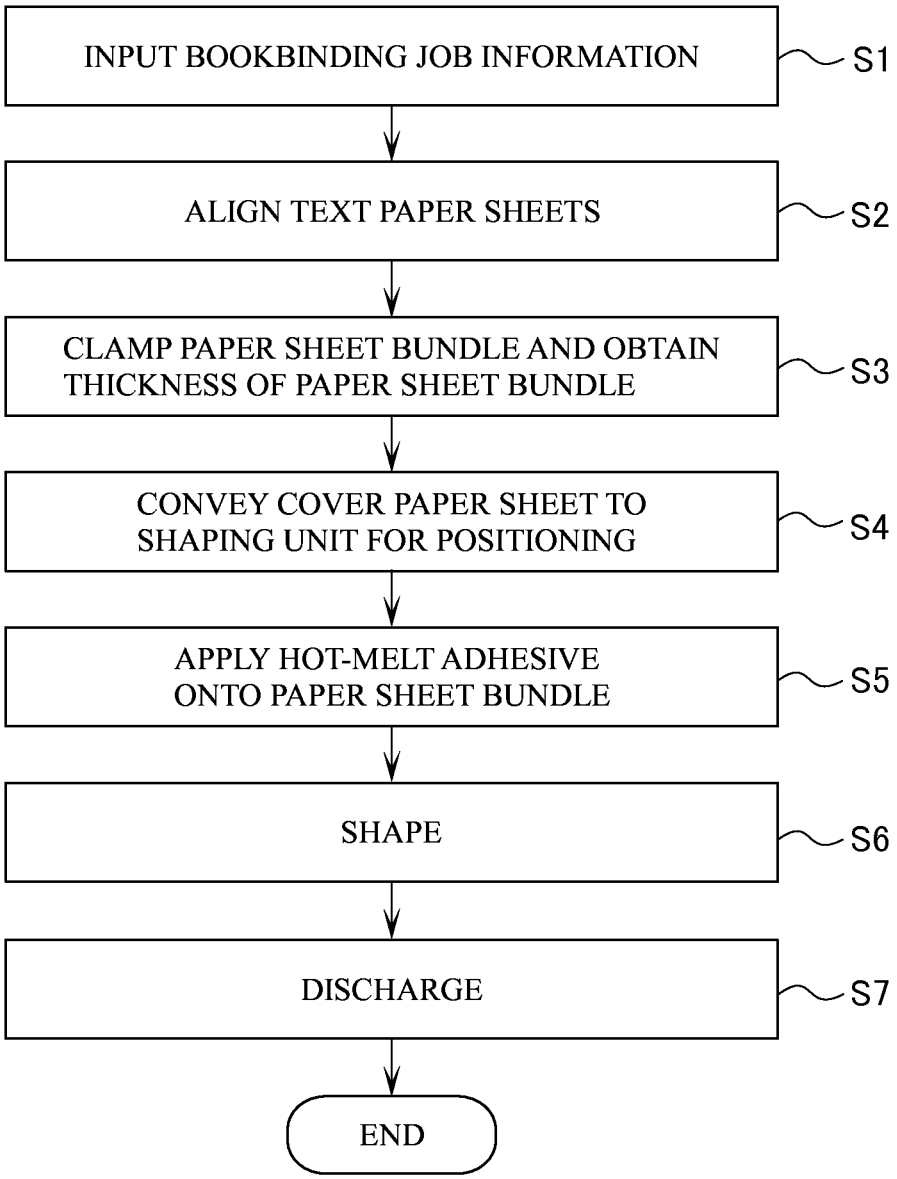
FIG. 4 is a flowchart for explaining a bookbinding operation.

First, the bookbinding control unit 50 obtains bookbinding job information from the exterior PC 5 or the like in Step S1 of FIG. 4. The bookbinding job information includes various pieces of information necessary for the special bookbinding operation such as the type (for example, A4) of text paper sheets P1, the type (for example, A3) of cover paper sheet P2, and the number of pages of the paper sheet bundle PS. It should be noted that image information of images to be printed on the text paper sheets P1 and the cover paper sheet P2 included in the bookbinding job information is input in the printing control unit 17 of the printing apparatus 2. Further, the bookbinding job information is obtained from the external PC 5 or the like. However, the bookbinding job information may be manually input by the user.

Figure 5:
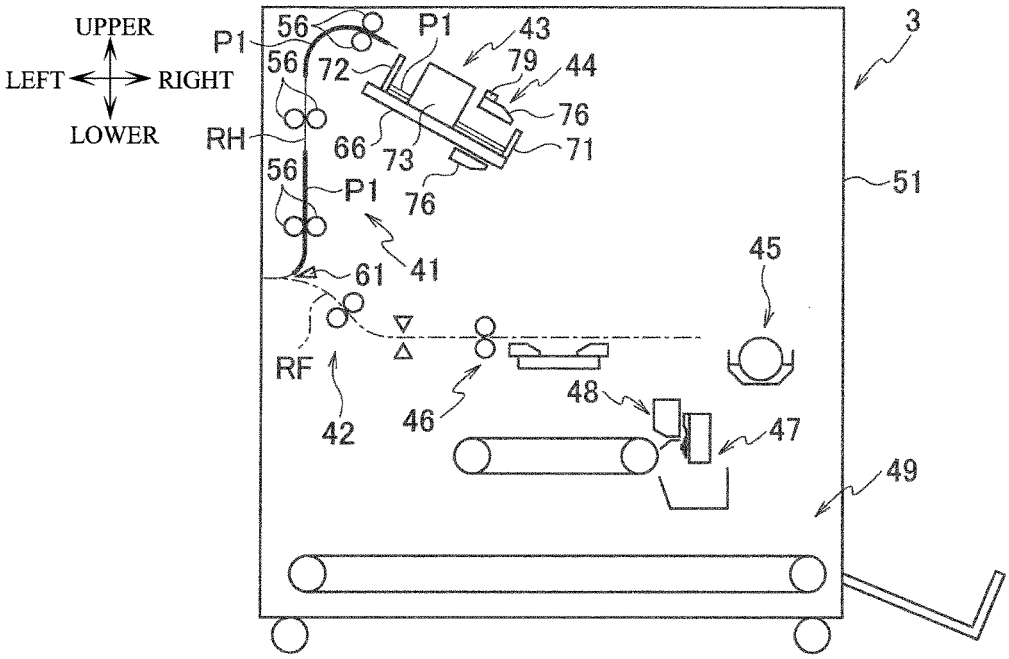
FIG. 5 is a diagram for explaining the bookbinding operation.

In Step S2 of FIG. 4, the bookbinding control unit 50 aligns the text paper sheets P1 printed by the printing apparatus 2. Specifically, as shown in FIG. 5, the bookbinding control unit 50 guides the text paper sheets P1 printed by the printing apparatus 2 to the text paper sheet conveyance rollers 56 using the switch unit 61, and allows the text paper sheet conveyance rollers 56 to convey the text paper sheets P1 to the aligning tray 66. When the text paper sheets P1 corresponding to the number of pages of one booklet are loaded on the aligning tray 66, the bookbinding control unit 50 adjusts and aligns the text paper sheets P1 for one booklet using the front-end fence 71, the rear-end fence 72, and the pair of side fences 73.

Next, in Step S3, the bookbinding control unit 50 clamps the paper sheet bundle PS composed of the text paper sheets P1 for one booklet by closing the pair of clamp plates 76. In this case, the paper sheet bundle thickness sensor 79 measures the thickness of the paper sheet bundle PS. The bookbinding control unit 50 obtains the thickness of the paper sheet bundle PS from the paper sheet bundle thickness sensor 79. It should be noted that the bookbinding control unit 50 may obtain the thickness of the paper sheet bundle PS by computation on the basis of the number of pages of and the type of text paper sheets P1 from the bookbinding job information.

Figure 6:
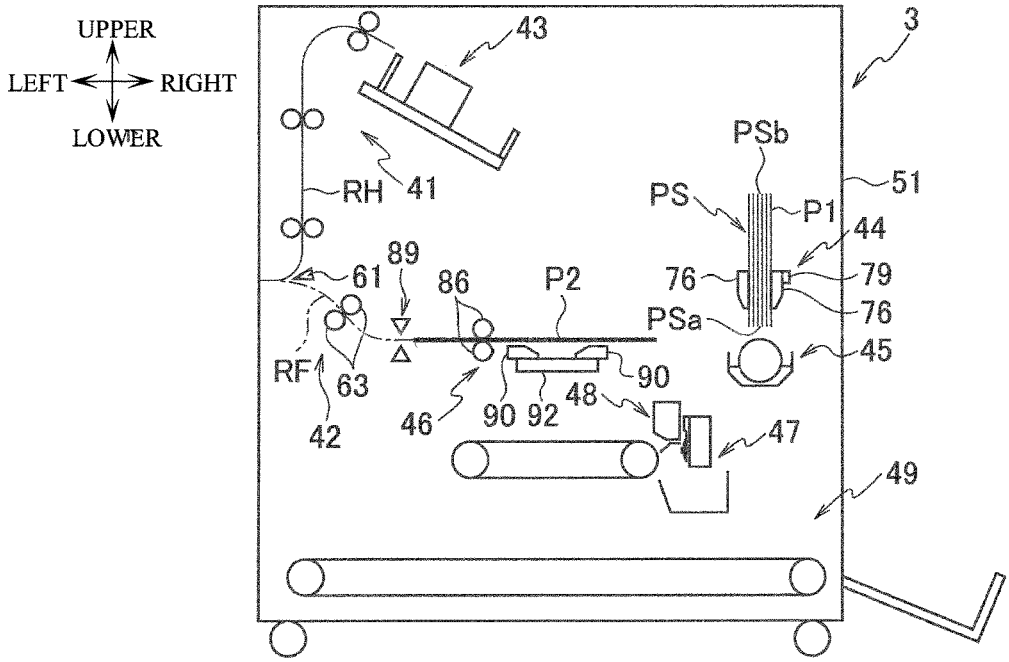
FIG. 6 is a diagram for explaining the bookbinding operation.

Next, in Step S4, the bookbinding control unit 50 guides the cover paper sheet P2 printed by the printing apparatus 2 to the cover paper sheet conveyance rollers 63 using the switch unit 61, and allows the cover paper sheet conveyance rollers 63 to convey the cover paper sheet P2 to the shaping unit 46. Then, as shown in FIG. 6, the bookbinding control unit 50 arranges the cover paper sheet P2 on the pair of rear-part bending plates 90 using the cover paper sheet carrying rollers 86 of the shaping unit 46. At the same time, as shown in FIG. 6, the bookbinding control unit 50 moves the pair of clamp plates 76 clamping the paper sheet bundle PS to the upper side of the adhesive applying unit 45.

The arrangement of the cover paper sheet P2 on the rear-part bending plates 90 in the shaping unit 46 will be described herein.

Figure 7:
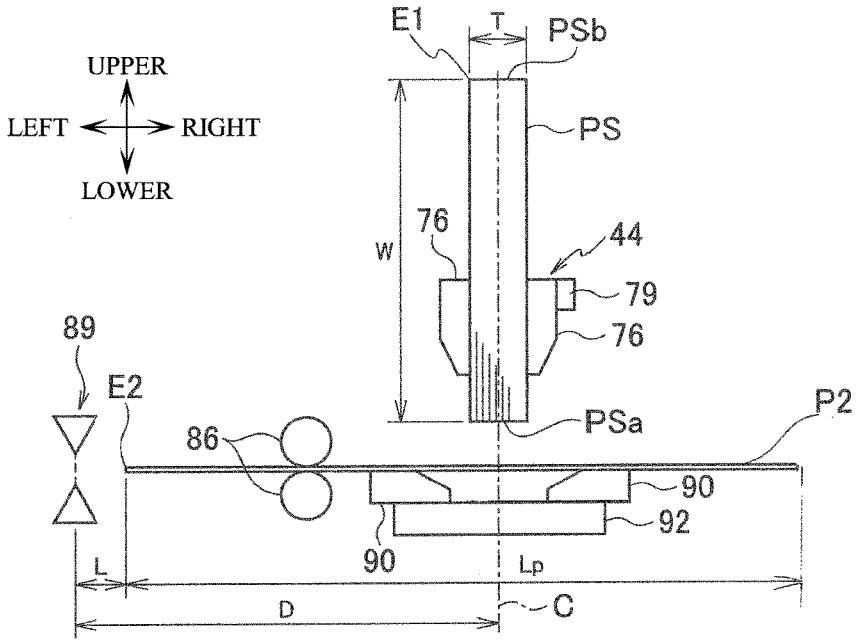
FIG. 7 is a diagram for explaining the arrangement of text paper sheets on rear-part bending plates in a shaping unit.

In a shaping process to be described later, as shown in FIG. 7, the pair of clamp plates 76 clamping the paper sheet bundle PS is arranged on the upper side of the abutting plate 92. In this case, the paper sheet bundle PS is held in such a manner that the spine PSa is allowed to face down, and the spine PSa and an end surface PSb on the fore edge side become horizontal. The vertical direction of the paper sheet bundle PS corresponds to the direction (front-rear direction) orthogonal to the drawing. Further, the center of the paper sheet bundle PS in the thickness direction (right-left direction) matches the center line C. The center line C shows the center of the abutting plate 92 in the right-left direction, and the pair of rear-part bending plates 90 is symmetrically moved relative to the center line C.

As shown in FIG. 7, the shaping unit 46 arranges the cover paper sheet P2 so that the left edge E1 on the fore edge side of the paper sheet bundle PS and the left edge E2 of the cover paper sheet P2 are aligned to each other after shaping. These edges E1 and E2 are edges extending in the direction (front-rear direction) orthogonal to the drawing of FIG. 7, and are edges on the front side in the completed booklet. Further, the paper sheet bundle PS is lowered straight down from the state of FIG. 7, and the spine PSa abuts on the abutting plate 92 through the rear part (corresponding to a spine P2R formed in the following process, see FIG. 9) of the cover paper sheet P2 at the time of shaping. Further, the pair of rear-part bending plates 90 press the lower end of the paper sheet bundle PS through the cover paper sheet P2 from the right and left sides, so that the cover paper sheet P2 is bent, and the front part (front cover P2F) of the cover and the back part (back cover P2B) of the cover are formed.

Therefore, when the width of the paper sheet bundle PS (text paper sheets P1) and the thickness of the paper sheet bundle PS are defined as W and T, respectively, the cover paper sheet P2 is arranged in such a manner that the edge E2 of the cover paper sheet P2 is located apart from the center line C by only "W+T/2". Specifically, the bookbinding control unit 50 controls the respective units of the shaping unit 46 to adjust the relative arrangement of the paper sheet bundle PS and the cover paper sheet P2, so that the case binding is carried out while allowing the edge of the front part of the cover paper sheet P2 and the edge of the front surface of the paper sheet bundle PS to match each other.

Specifically, if the paper sheet sensor 89 detects a rear end (left end in FIG. 7) of the cover paper sheet P2 when the cover paper sheet P2 is carried to the shaping unit 46, the bookbinding control unit 50 starts to count the number of output pulses of the encoder 88. Further, when the conveyance distance L of the cover paper sheet carrying rollers 86 in accordance with the counted value matches a value satisfying the following equation (1), the bookbinding control unit 50 stops the cover paper sheet carrying rollers 86.

$$L=D-(W+T/2) \quad (1)$$

In the equation, D represents a distance (fixed value) between the paper sheet sensor 89 and the center line C.

It should be noted that A4 regular paper sheets are used for the text paper sheets P1, an A3 regular paper sheet is used for the cover paper sheet P2, and the A4 paper sheet bundle that is aligned in a vertically-long manner is bound by case bookbinding using the horizontally-long A3 cover paper sheet in the embodiment. Thus, the length Lp of the cover paper sheet P2 is twice the width W of the text paper sheets P1, and Lp=2W is satisfied. However, when the thickness T of the paper sheet bundle PS is taken into account, the length Lp of the cover paper sheet P2 is insufficient to cover the entire surfaces of the front surface, the rear surface, and the back surface of the paper sheet bundle PS. Specifically, although the length of the back cover is represented as Lp−(W+T), the value is smaller than W.

Further, as described above, the edge E1 of the paper sheet bundle PS and the edge E2 of the cover paper sheet P2 are aligned to each other on the front side of the booklet B in the special bookbinding operation. Thus, the front surface PSF and the rear surface PSa of the paper sheet bundle PS are completely covered with the cover paper sheet P2. However, the entire surface of the back surface PSB of the paper sheet bundle PS cannot be covered with the back part (back cover P2B) of the cover paper sheet P2, and a part of the back surface PSB of the paper sheet bundle PS is exposed without being covered with the cover paper sheet P2.

As described above, according to the special bookbinding operation in the embodiment, a part of the back surface PSB of the paper sheet bundle PS cannot be covered in accordance with the thickness T of the paper sheet bundle PS. However, the back surface side of the booklet B is on the inconspicuous side as compared to the front surface, and the uncovered part is not a problem in some cases depending on the intended use of the booklet. For example, in the case of booklets for sale and for important or official use, it can be possibly said that the insufficient dimension of the back cover is a problem in appearance. If the booklets are distributed to limited special organizations and are used with the low necessity of consideration of exterior or appearance, it is conceivable that the characteristics of the exterior irrelevant to the content are not a serious problem. It should be noted that an example of A-type regular paper sheets has been described above. However, the same is true of a case where the paper sheet bundle PS is produced using the B4 text paper sheets P1, and is bound by case bookbinding using the B3 cover paper sheet P2.

Referring back to FIG. 4, in Step S5 after Step S4, the bookbinding control unit 50 allows the adhesive applying unit 45 to apply the hot-melt adhesive G onto the paper sheet bundle PS. Specifically, the bookbinding control unit 50 lowers the pair of clamp plates 76 clamping the paper sheet bundle PS from the position above the adhesive applying unit 45 to allow the spine PSa to be contacted with the applying roller 82. Accordingly, the hot-melt adhesive G is applied to the spine PSa of the paper sheet bundle PS.

Next, in Step S6, the bookbinding control unit 50 allows the shaping unit 46 to shape the booklet B.

Figure 8:
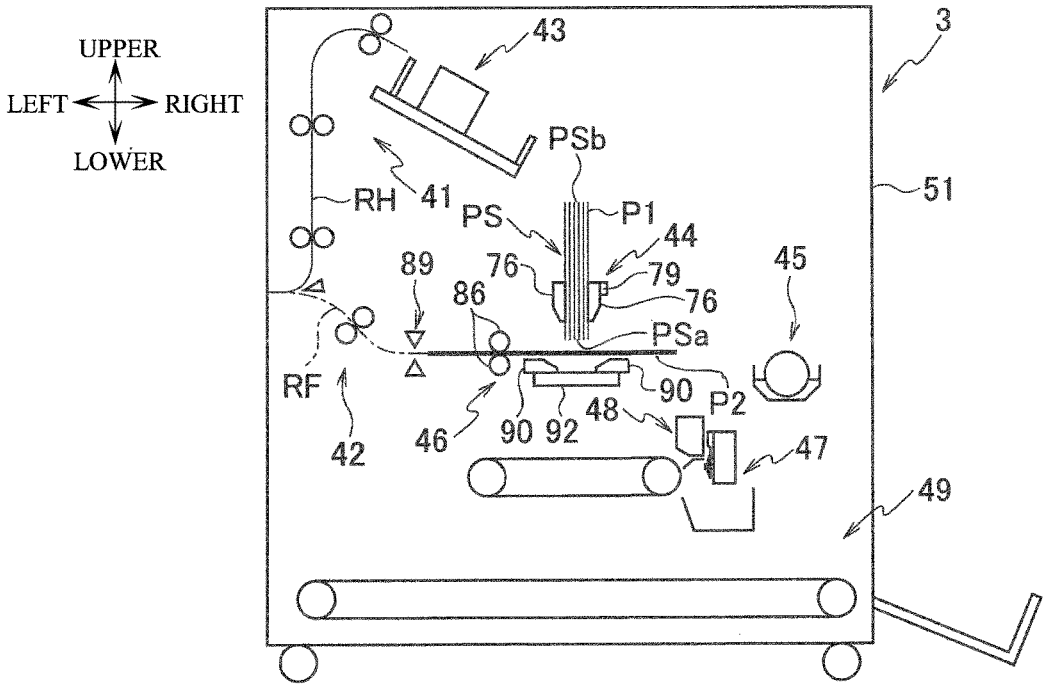
FIG. 8 is a diagram for explaining the bookbinding operation.

Specifically, in the first place, the bookbinding control unit 50 moves the paper sheet bundle PS with the hot-melt adhesive G applied above the abutting plate 92 as shown in FIG. 8. In this case, the paper sheet bundle PS is arranged in such a manner that the center in the thickness direction matches the center line C as shown in FIG. 7. Next, the bookbinding control unit 50 lowers the pair of clamp plates 76 clamping the paper sheet bundle PS to allow the spine PSa with the hot-melt adhesive G applied to abut on the abutting plate 92 through the cover paper sheet P2. Accordingly, the paper sheet bundle PS adheres to the cover paper sheet P2.

Figure 9:
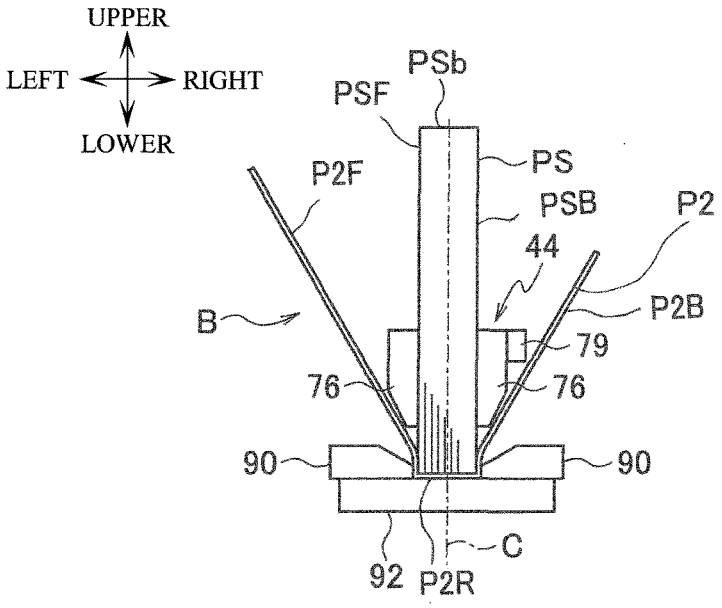
FIG. 9 is an enlarged view for explaining an operation of shaping a booklet in the shaping unit.

Thereafter, the bookbinding control unit 50 moves the pair of rear-part bending plates 90 so as to come close to each other, and a lower end of the paper sheet bundle PS is pressed from the right and left sides by the pair of rear-part bending plates 90 through the cover paper sheet P2 as shown in FIG. 9. Accordingly, the boundary between the spine P2R and the front cover P2F of the cover paper sheet P2 and the boundary between the spine P2R and the back cover P2B are bent. As a result, the booklet B is shaped.

Figure 10:
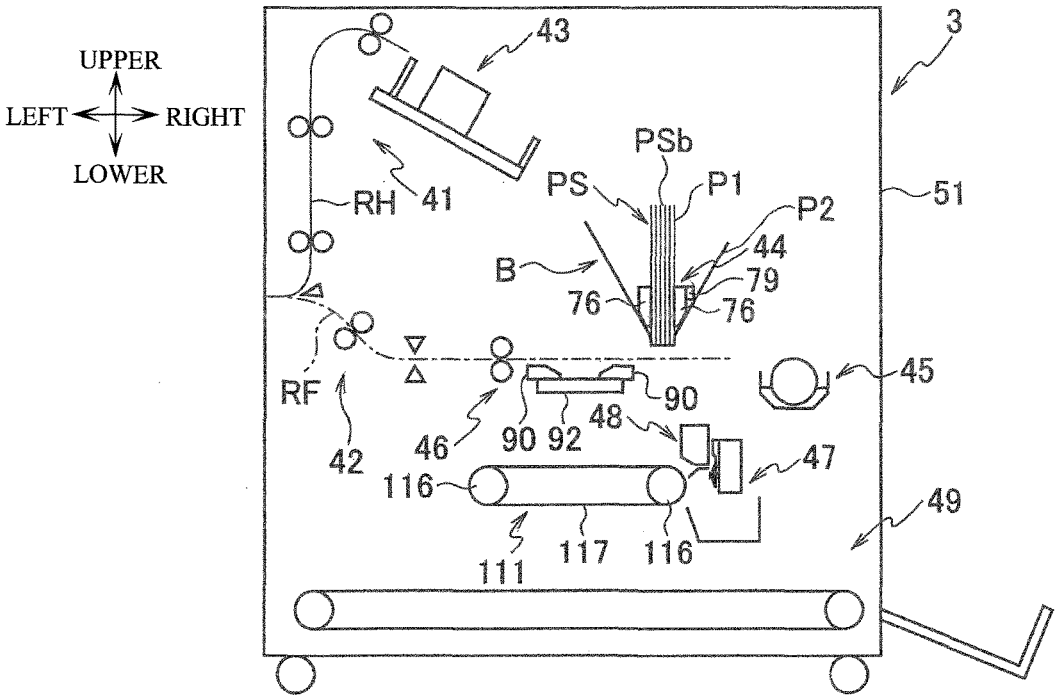
FIG. 10 is a diagram for explaining the bookbinding operation.
Figure 11:
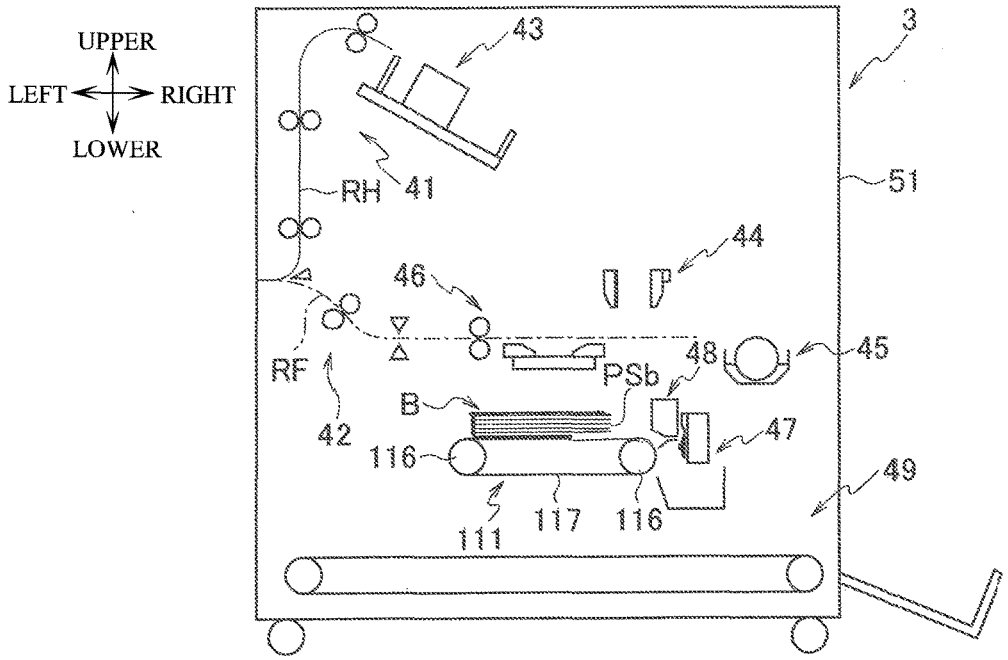
FIG. 11 is a diagram for explaining the bookbinding operation.
Figure 12:
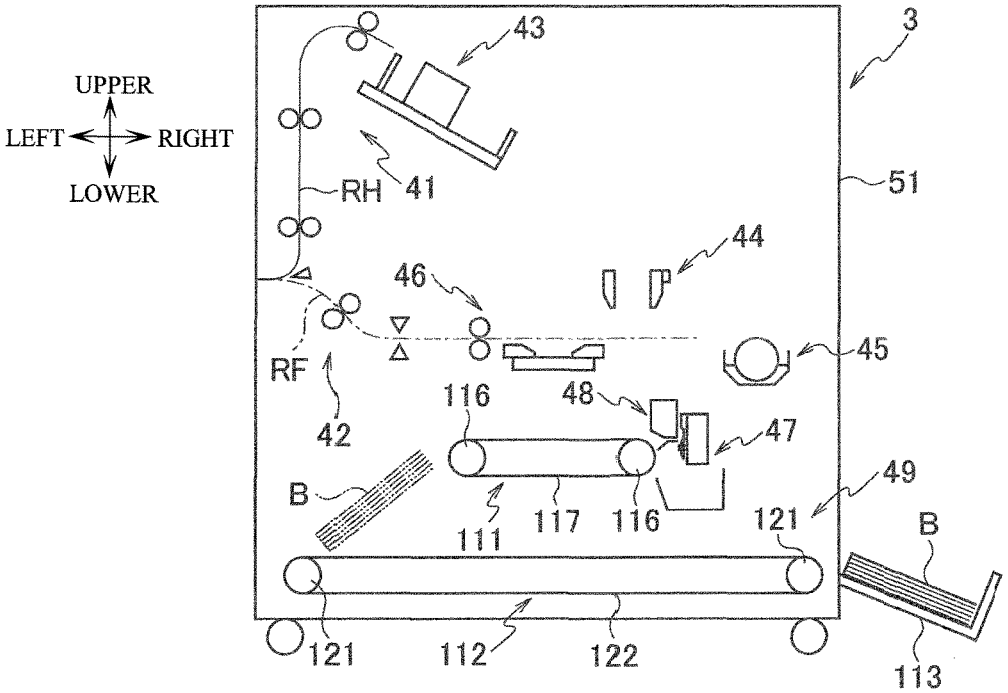
FIG. 12 is a diagram for explaining the bookbinding operation.

Referring back to FIG. 4, when the booklet B is shaped in Step S6, the bookbinding control unit 50 executes a process of discharging the completed booklet B to the receiving base 113 in Step S7. Specifically, the bookbinding control unit 50 moves the pair of clamp plates 76 clamping the paper sheet bundle PS of the booklet B to the right side of the rear-part bending plates 90 and the abutting plate 92 as shown in FIG. 10, and releases the clamping. Accordingly, the booklet B is dropped on the conveyance belt 117 of the booklet conveyance conveyor 111. After the booklet B is dropped on the booklet conveyance conveyor 111, the bookbinding control unit 50 rotates the conveyance belt 117 in the counterclockwise direction in FIG. 1. Accordingly, the booklet B is loaded on the conveyance belt 117 as shown in FIG. 11. Further, the bookbinding control unit 50 rotates the conveyance belt 117 with the booklet B loaded in the counterclockwise direction, and the booklet B is dropped on the booklet discharging conveyor 112 as shown in FIG. 12. Further, the booklet B is conveyed to the right direction by the booklet discharging conveyor 112, and is discharged to the receiving base 113 as shown in FIG. 12.

Then, the bookbinding operation is finished.

It should be noted that in the case where the normal bookbinding operation is carried out in the bookbinding system 1, the booklet B is loaded on the booklet conveyance conveyor 111 as shown in FIG. 11, and then the booklet conveyance conveyor 111 is rotated in the clockwise direction to send the booklet B to the cutting unit 47. Then, a surplus cover paper sheet P2 protruding from the edge of the paper sheet bundle PS is cut by the rotary cutter unit 96 by a necessary length. Thereafter, the completed booklet B is conveyed by the conveyance belt 117 to be dropped on the booklet discharging conveyor 112 as shown in FIG. 12, and is discharged to the receiving base 113 by the booklet discharging conveyor 112.

FIG. 13 and FIG. 14 show the booklet B obtained as a result of the special bookbinding operation in the embodiment. As described above, according to the bookbinding system of the embodiment, the front part of the cover paper sheet P2, namely, the edge E2 of the front cover P2F and the edge E1 of the front surface PSF of the paper sheet bundle PS are allowed to match each other to bind the paper sheet bundle PS using the cover paper sheet P2. Accordingly, the entire surfaces of the front surface PSF and the spine PSa of the paper sheet bundle PS can be covered with the cover paper sheet P2. As shown in the drawing, a part of the back surface PSB of the paper sheet bundle PS cannot be covered in accordance with the thickness T of the paper sheet bundle PS. However, the back surface PSB is on the inconspicuous side as compared to the front surface PSF, and the uncovered part is not a problem depending on the intended use of the booklet B.

In the case where there is a printed image on the final page of the paper sheet bundle PS in the special bookbinding operation in the bookbinding system 1, one text paper sheet P1 may be added to the next of the final page. Specifically, a part of the back surface PSB of the paper sheet bundle PS cannot be covered with the cover paper sheet P2 in accordance with the thickness T of the paper sheet bundle PS in the special bookbinding operation of the embodiment. Thus, if there is a printed image on the final page at a part that is not covered with the cover paper sheet P2, the printed image is possibly exposed without being covered with the cover paper sheet P2. In this case, there is a risk that the printed image on the final page is stained when handling the booklet B. Accordingly, if one text paper sheet P1 is added to the next of the final page on which the image is formed to form the paper sheet bundle PS as described above, the printed image is covered with the added text paper sheet P1. Thus, even if an image is formed at any position, the image is not exposed, and it is unlikely that the image is stained due to friction against foreign substances or the like. It should be noted that the printing control unit 17 or the bookbinding control unit 50 may determine whether or not there is a printed image on the final page of the paper sheet bundle PS.

Further, in the case where it is determined that there is a printed image on the final page of the paper sheet bundle PS, the printed region of the printed image on the final page is compared to the region where the back part (back cover P2B) of the cover paper sheet P2 covers the final page, namely, the covered region. Only when at least a part of the printed image on the final page is exposed, one text paper sheet P1 can be added. Even if a part of the back surface PSB of the paper sheet bundle PS cannot be covered with the cover paper sheet P2 in accordance with the thickness T of the paper sheet bundle PS and there is a printed image on the final page, no text paper sheet P1 is added unless the printed image on the final page is actually exposed without being covered with the cover paper sheet P2. Thus, no text paper sheet P1 is wastefully added to protect the printed image on the final page. It should be noted that the comparison between the printed region of the printed image on the final page and the region covered with the back part (back cover P2B) of the cover paper sheet P2 and the determination on the basis of the comparison result may be made by the printing control unit 17 or the bookbinding control unit 50.

Next, in the case where there is no exposed part on the final page of the text paper sheets P1 and no printed image to be formed on the back cover P2B of the cover paper sheet P2 in the above-described special bookbinding operation of the bookbinding system 1, appropriate images are formed on these regions and the exterior of the short back cover P2B can be improved to enhance the appearance. The image information process and the printing process are carried out by the printing control unit 17.

Figure 15:
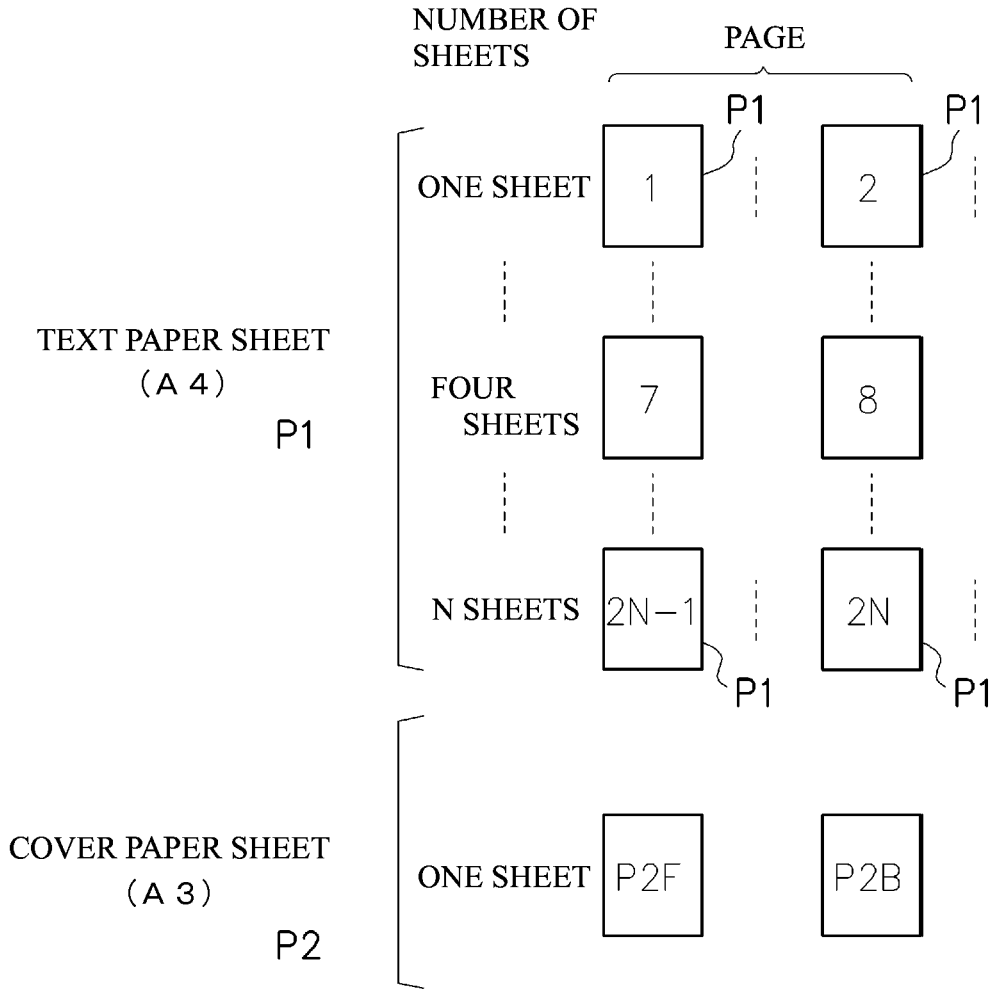
FIG. 15 is a diagram for schematically showing a configuration of the number of and pages of text paper sheets and cover paper sheets shaped in the booklet in the bookbinding system of the embodiment.

FIG. 15 schematically shows a configuration of the page number of each sheet of the text paper sheets P1 of the paper sheet bundle PS configuring the booklet B and the cover paper sheets P2, and a configuration of the cover in the bookbinding system 1 of the embodiment. Specifically, on the assumption that the A4 text paper sheets P1 are used and the number of text paper sheets P1 is N, Page 1 and Page 2 are allocated to the front and back of the first sheet, respectively. Similarly to the above, Page (2N−1) and Page 2N are allocated to the front and back of the N-th sheet, respectively. The final page is Page 2N. One A3 cover paper sheet P2 is used, and one half on the one surface side is allocated to the front part (front cover P2F) of the cover paper sheet P2 and the other half is allocated to the back part (back cover P2B) of the cover paper sheet. In such a page configuration of the booklet B, in the case where the back cover P2B of the booklet B obtained in the special bookbinding operation becomes short as shown in FIG. 13 and FIG. 14, the printing control unit 17 carries out the image information process and the printing process so as to make the short back cover P2B inconspicuous.

FIGS. 16A to 16G are diagrams for schematically showing an example of printed images to be formed at a part of the final page of the text paper sheets P1 that is exposed without being covered with the back cover P2B and on the back cover P2B of the cover paper sheet P2 having no images to be printed in the bookbinding system 1 of the embodiment.

Figure 16A:
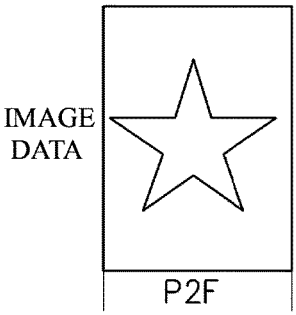
FIGS. 16A to 16G are diagrams for schematically showing a first example of printed images shaped on the final page of the text paper sheets and the cover paper sheet shaped in the booklet in the bookbinding system of the embodiment.
Figure 16B:
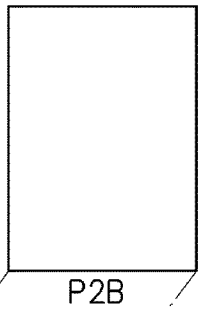
Figure 16C:
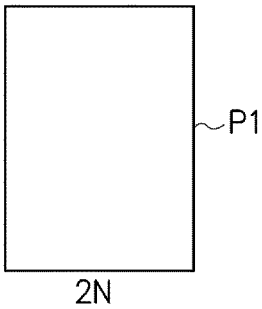
Figure 16D:
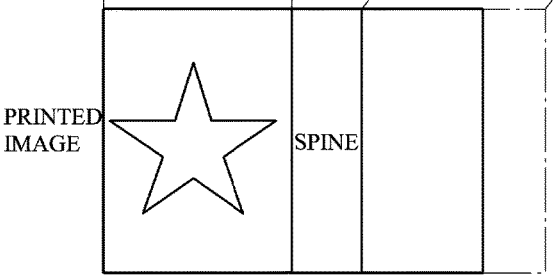
Figure 16E:
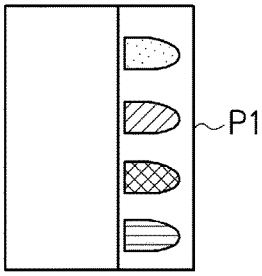

As shown in FIG. 16A, an image (a star in the drawing) to be printed on the front cover P2F is designated. However, as shown in FIGS. 16B and 16C, images to be printed on the back cover P2B and the final page 2N of the text paper sheets P1 are not designated. In this case, when the thickness T of the paper sheet bundle PS shown in FIG. 7 is taken into account, the length of the back cover P2B becomes short as shown in FIG. 16D, resulting in unnatural appearance. Accordingly, as shown in FIG. 16E, an arbitrary pattern is formed as a printed image at a region of the final page 2N of the text paper sheets P1 that is exposed without being covered with the short back cover P2B. In the illustrated example, graphics of four types are printed. Accordingly, the boundary between the back cover P2B and the final page 2N becomes inconspicuous, and the unnaturalness of the short length of the back cover P2B can be eliminated. It should be noted that a printed image may exist at a part of the final page of the text paper sheets P1 that is covered with the back cover P2B in this case.

Figure 16F:
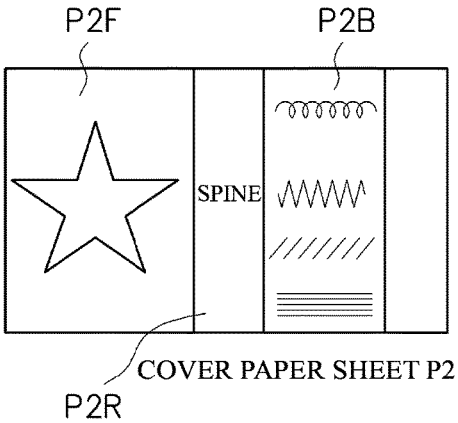
Figure 16G:
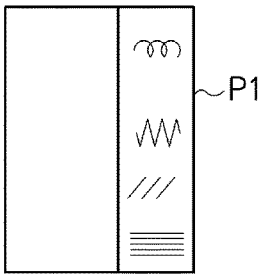

As shown in FIGS. 16F and 16G, continuous specific images may be formed on the back cover P2B of the cover paper sheet P2 and at a part of the final page 2N of the text paper sheets P1 that is exposed without being covered with the back cover P2B. In the illustrated example, designs of lines of four types are continuously printed between the back cover P2B and the final page 2N of the text paper sheets P1. Thus, the boundary between the back cover P2B and the final page 2N becomes inconspicuous, and the unnaturalness of the short length of the back cover P2B can be eliminated. It should be noted that a printed image may exist at a part of the final page of the text paper sheets P1 that is covered with the back cover P2B in this case.

FIGS. 17A to 17F are diagrams for schematically showing a processing method of image information in the case where an image (a star in the illustrated example) to be printed on the back cover P2B of the cover paper sheet P2 is designated in the bookbinding system 1 of the embodiment, but cannot be printed in a complete shape due to the short length of the back cover P2B.

Figure 17A:
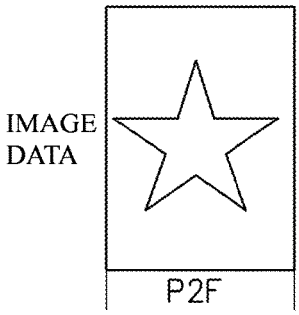
FIGS. 17A to 17F are diagrams for schematically showing a second example of printed images shaped on the final page of the text paper sheets and the cover paper sheet shaped in the booklet in the bookbinding system of the embodiment.
Figure 17B:
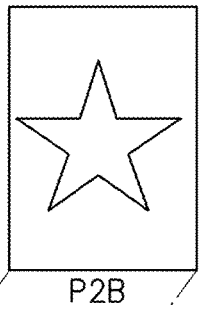
Figure 17C:
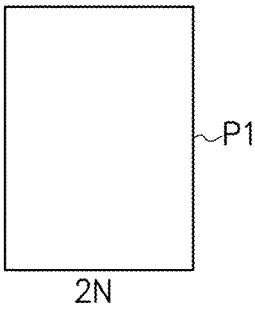
Figure 17D:
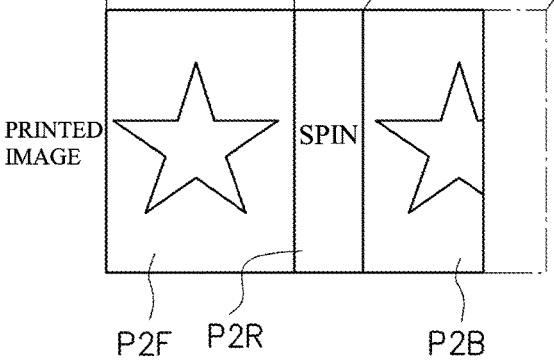
Figure 17E:
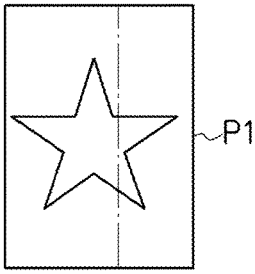
Figure 17F:
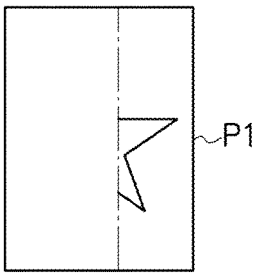

As shown in FIGS. 17A and 17B, an image to be printed is designated for each of the front cover P2F and the back cover P2B. However, as shown in FIG. 17C, an image to be printed is not designated for the final page 2N of the text paper sheets P1. In this case, when the thickness T of the paper sheet bundle PS shown in FIG. 7 is taken into account, the length of the back cover P2B becomes short as shown in FIG. 17D, resulting in unnatural appearance. Further, the image cannot be printed at a region eliminated due to the short length of the back cover P2B. In the example of FIG. 17D, only a part of the designated star is printed. Accordingly, as shown in FIG. 17E, the entire image to be formed on the back cover P2B is formed on the final page 2N as a printed image. A part of the image of the star formed on the final page 2N that is not covered with the back cover P2B and a part of the star that is the printed image of the back cover P2B are continuous. Thus, when the booklet B is viewed from the back side, the image of a whole star can be visually confirmed. Accordingly, the boundary between the back cover P2B and the final page 2N becomes inconspicuous, and the unnaturalness of the short length of the back cover P2B can be eliminated.

As shown in FIG. 16F, an image of one part of the star continuous with the other part of the star that is the printed image on the back cover may be formed at a part of the final page 2N that is not covered with the back cover. By employing the process, the image of a whole star can be visually confirmed. Accordingly, the boundary between the back cover and the final page 2N becomes inconspicuous, and the unnaturalness of the short length of the back cover can be eliminated.

As described above, according to the bookbinding system 1, even though the above-described specific image such as a star is supposed to be formed on the back cover P2B of the cover paper sheet P2, the entire specific image cannot be possibly formed on the back cover P2B of the short cover paper sheet P2 in some cases because the length of the back cover P2B of the cover paper sheet P2 becomes short in accordance with the thickness T of the paper sheet bundle PS. Even in such a case, while a part of the specific image is formed on the back cover P2B of the cover paper sheet P2, an image based on the specific image is formed on the final page of the paper sheet bundle PS so as to be continuous with the part of the specific image formed on the back cover P2B of the cover paper sheet P2. Accordingly, these images are combined to each other to configure the entire specific image. Thus, a sense of visual discomfort can be eliminated, and the problem of the exterior of the booklet B due to the short length of the back cover P2B can be made inconspicuous.

According to the bookbinding system 1 of the embodiment described above, for example, while the edge E1 of the A4 paper sheet bundle PS and the edge E2 of the front side of the A3 cover paper sheet P2 are allowed to match each other, the paper sheet bundle PS is bound using the cover paper sheet P2. Accordingly, as shown in FIG. 13 and FIG. 14, the booklet B is produced in such a state that the front cover P2F and the spine P2R cover the paper sheet bundle PS, but a part of the final page is exposed due to the short length of the back cover P2B. However, the bookbinding system 1 of the embodiment can carry out a different special bookbinding operation.

Figure 18A:
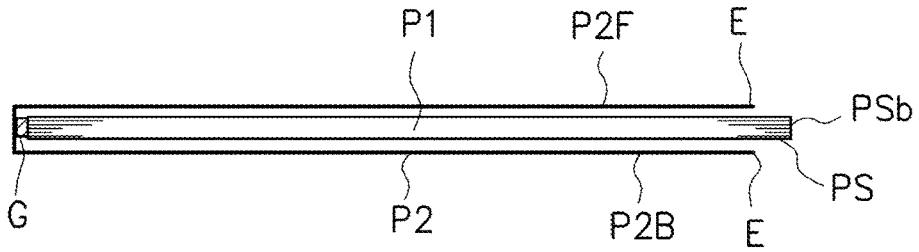
FIG. 18A is a diagram of a booklet of a second mode example that is shaped in the bookbinding system of the embodiment and is viewed from the parallel direction of the drawing.

For example, in the case where the paper sheet bundle PS is relatively thin as shown in FIG. 18A, when regular paper sheets with the same series and different sizes are combined to each other, the bookbinding may be performed in such a manner that the edges E of the paper sheet bundle PS and the cover paper sheet P2 are shifted by the same dimension on the sides of the front cover P2F and the back cover P2B. In order to obtain such a shape, for example, the paper sheet bundle PS composed of A4 text paper sheets P1 is bound by case bookbinding while being positioned in the middle of the A3 cover paper sheet P2. In this case, the end surface PSb on the fore edge side of the paper sheet bundle PS slightly protrudes from the cover paper sheet P2 on the front and back sides. However, it is conceivable that there is no problem in appearance due to the small dimension. In the case where the thickness of the booklet B is relatively small, the value of the thickness T of the above-described paper sheet bundle PS is small. This means that there is no problem with the exterior of the booklet even if Lp is regarded as almost equal to 2W+T (Lp≈2W+T).

Figure 18B:
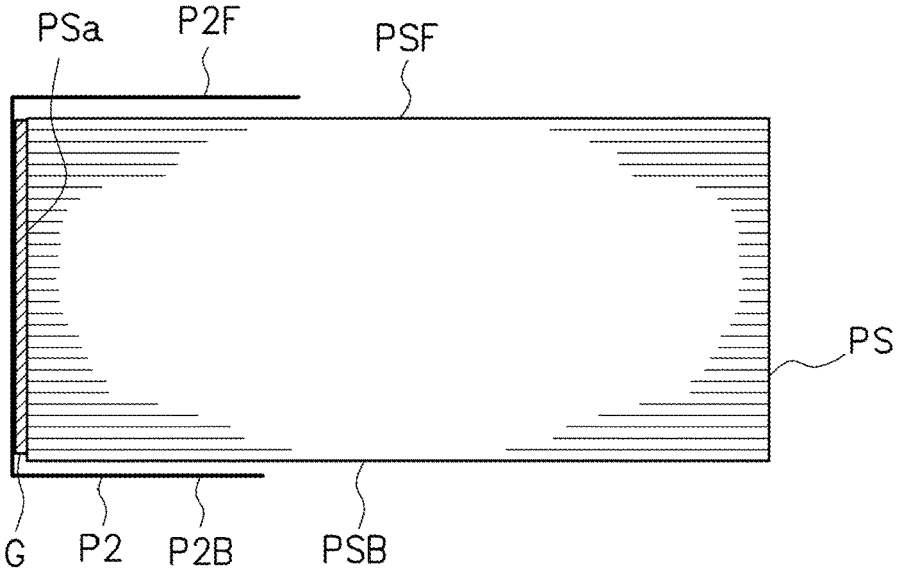
FIG. 18B is a diagram of a booklet of a third mode example that is shaped in the bookbinding system of the embodiment and is viewed from the parallel direction of the drawing.

Further, as shown in FIG. 18B, in the case where the thickness T of the paper sheet bundle PS is very large, at least only the spine PSa of the paper sheet bundle PS may be bound using the cover paper sheet P2. In order to obtain such a shape, for example, the entire surface of the spine PSa of the A4 paper sheet bundle PS and a part of each of the front surface PSF and the back surface PSB close to the spine PSa are similarly bound by case bookbinding using the A4 cover paper sheet P2.

The bookbinding manner shown in FIG. 18A or 18B can be realized by the bookbinding system 1 of the embodiment.

Further, regular paper sheets are used in the special bookbinding by the bookbinding system 1 of the embodiment as described above. However, a regular or irregular paper sheet can be used as the cover paper sheet P2 as long as the sheet has a size not protruding from the region configured with the front surface, the back surface, and the spine of the paper sheet bundle PS. Specifically, the cover paper sheet P2 always covers a part of each of the front surface, the back surface, and the spine of the paper sheet bundle PS. However, it is not always necessary to cover the all of each surface. Thus, after the case binding, a part of the cover paper sheet P2 binding the paper sheet bundle PS does not protrude to the outside of the outer shape of the paper sheet bundle PS, and it is not necessary to cut the cover paper sheet.

Further, each unit of the shaping unit 46 is appropriately controlled to adjust the relative arrangement of the paper sheet bundle PS and the cover paper sheet P2, so that the area of a region on the front surface PSF of the paper sheet bundle PS that is covered with the cover paper sheet P2 is equal to or larger than the area of a region on the back surface PSB of the paper sheet bundle PS that is covered with the cover paper sheet P2 in the positioning process for the paper sheet bundle PS and the cover paper sheet P2 described above while referring to FIG. 7 to FIG. 9 in the special bookbinding by the bookbinding system 1 of the embodiment. Accordingly, in the case where it is not necessary to completely cover the front surface PSF on the basis of the states of a range where an image is printed on the front surface PSF (the first page of the booklet B) of the paper sheet bundle PS or a margin where no image is printed, the part of the cover paper sheet P2 allocated to the front surface PSF of the paper sheet bundle PS is reduced, and can be used for the back surface PSB if necessary. Thus, the convenience can be improved when producing the booklet B.

Further, in the above-described special bookbinding without cutting the paper sheets in the embodiment, the user may instruct the apparatus to or the apparatus may automatically determine the paper sheets of which paper feeding tray are selected as the cover paper sheets P2, or which mode of case binding is selected among those exemplified in FIG. 13, FIG. 14, and FIGS. 18A and 18B, namely, how each of the front surface, the back surface, and the spine of the paper sheet bundle PS is covered with the cover paper sheet P2.

In the case of the instruction by the user, the user may instruct to use paper sheets other than dedicated paper sheets (dedicated cover paper sheets) used as the cover paper sheets P2, or not to use the dedicated cover paper sheets. In the case of the instruction of not using the dedicated cover paper sheets, the booklet B can be advantageously produced at low cost because the dedicated paper sheets are not used.

Further, in the case of the automatic selection by the apparatus, it is conceivable that, for example, the dedicated cover paper sheets run out, or the use of the dedicated cover paper sheets is restricted by a manager of the apparatus. Even in such cases, the booklet can be advantageously produced by the automatic determination by the apparatus although the booklet is limited to uses requiring no good appearance.

Further, in the case of the automatic selection by the apparatus, the printing control unit 17 and the bookbinding control unit 50 select the paper feeding tray storing the cover paper sheets P2 suitable for the special bookbinding operation. Specifically, the printing control unit 17 and the bookbinding control unit 50 select the paper feeding tray storing the paper sheets having a size satisfying the conditions of the case bookbinding, namely, fitting within the size of the expanded paper sheet bundle PS on the basis of designation of the default preliminarily set in the apparatus or automatic determination based on the job information. Further, in particular, in the case where the case bookbinding is carried out in such a manner that the spine PSa of the paper sheet bundle PS is completely covered with the cover paper sheet P2, the printing control unit 17 and the bookbinding control unit 50 select the paper feeding tray storing the paper sheets whose length in the longitudinal or lateral direction matches the length in the direction orthogonal to the direction of the thickness T at the spine PSa of the paper sheet bundle PS. Then, the paper sheets of the selected paper feeding tray are supplied as the cover paper sheets P2, and each unit of the apparatus such as the shaping unit 46 is controlled, so that the case bookbinding operation is executed so as to cover, at least, a part of each of the front surface PSF, the back surface PSB, and the spine PSa of the paper sheet bundle PS.

As described above, according to the bookbinding system 1 of the embodiment, a regular or irregular cover paper sheet having a large size exceeding the size of a region obtained by expanding the paper sheet bundle PS is not used, and thus the booklet B can be shaped by covering, at least, a part of each of the front surface, the back surface, and the spine of the paper sheet bundle PS by case binding. In addition, various paper sheets can be selected for use in accordance with purposes and uses without fixing a combination of the paper sheet bundle PS and the cover paper sheet P2. Further, it is not necessary to cut the paper sheets after the case bookbinding, and the cutting waste is not generated. Further, if the length of the back cover P2B is shortened by such a special bookbinding operation and the exterior becomes unnatural, an appropriate design is printed on the final page of the booklet B, or a specific image supposed to be printed on the back cover P2B is integrally printed while being divided into the back cover P2B and the final page of the text paper sheets P1. Accordingly, a sense of discomfort of the exterior can be advantageously reduced or eliminated.

As described above, the present invention is characterized in that the case bookbinding is carried out without cutting the paper sheets. However, there is a conceivable method in which regular paper sheets are used, and the bookbinding is carried out while cutting the paper sheets if necessary.

Figure 19A:
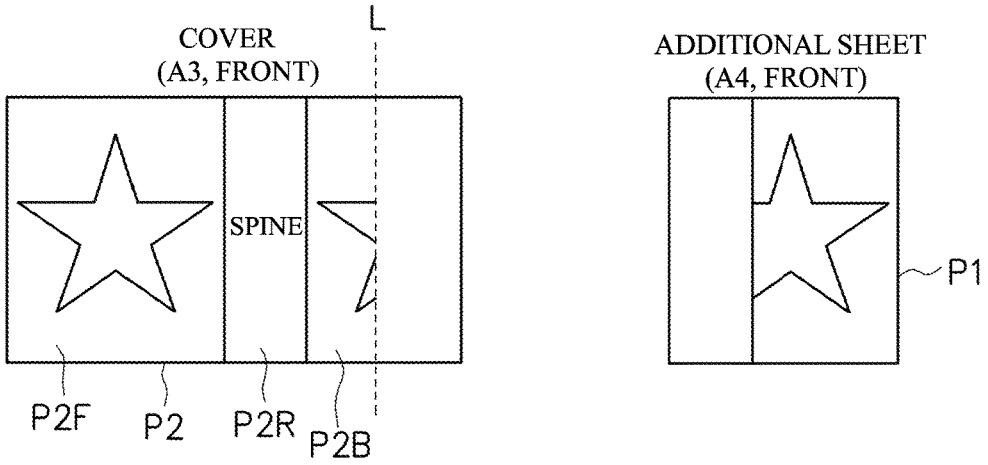
FIGS. 19A to 19C are diagrams for schematically showing a bookbinding method in which regular paper sheets are used for the text paper sheets and the cover paper sheet, and the cover paper sheet is configured by pasting a specially-cut regular paper sheet to another regular paper sheet to shape a booklet in which the front and back surfaces of the paper sheet bundle are covered with the cover paper sheet.
Figure 19B:
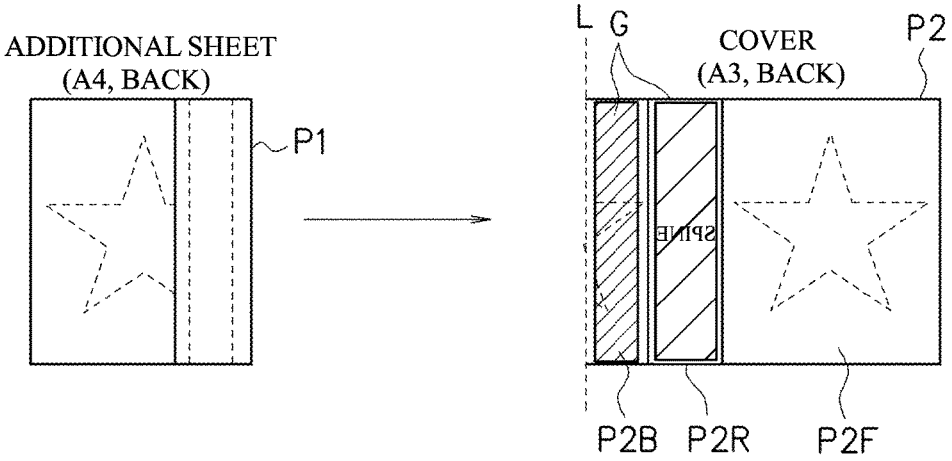
Figure 19C:
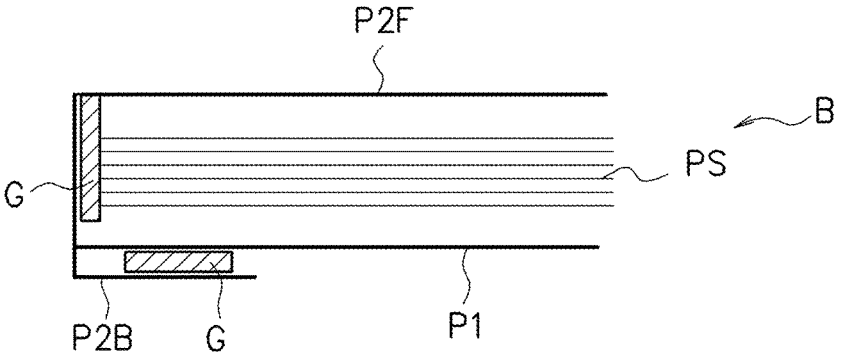

FIGS. 19A to 19C show a bookbinding method or a bookbinding structure according to another embodiment of the invention made by the inventors of the application. The paper sheet bundle PS composed of the vertically-long A4 text paper sheets P1 is bound by case bookbinding using the horizontally-long A3 cover paper sheet P2. In the method, the length of the cover paper sheet P2 becomes short in accordance with the thickness T of the paper sheet bundle PS as similar to the above-described embodiment. Thus, in order to make up for the lacking part, an A4 paper sheet (text paper sheet P1) is joined to the cover paper sheet P2 to cover the entire paper sheet bundle PS in just proportion.

Specifically, as shown in FIG. 19A, in the case where the A4 paper sheet bundle PS is bound by case bookbinding using the A3 cover paper sheet P2 while the edges on the cover side are aligned to each other, when the dimension of the back cover P2B is insufficient if the thickness T of the paper sheet bundle PS, namely, the dimension of the spine P2R is taken into account, the following bookbinding can be carried out.

As a bookbinding apparatus, the bookbinding system 1 of the above-described embodiment can be used. The document size (for example, A4) and image data (the front and back) of the text paper sheets P1, and the document size (for example, A3) and image data (the front, back, and spine) of the cover paper sheet P2 are notified to the bookbinding system 1 from the exterior PC 5 or the like.

The printing apparatus 2 of the bookbinding system 1 allows the printing control unit 17 to produce image data obtained by removing an image in the range (the right side of the cut line L) of the region to be cut later from image data printed on the back cover P2B of the cover paper sheet P2 as shown in the left drawing of FIG. 19A. Further, the printing control unit 17 produces image data for the cut part of the image data on the back cover P2B as image data to be printed on the A4 paper sheet (using the text paper sheet P1) added to make up for the lacking part as shown in the right drawing of FIG. 19A.

Then, as shown in FIG. 19A, the bookbinding system 1 allows the printing apparatus 2 to print the designated image on the text paper sheet P1 and the cover paper sheet P2. As shown in the right drawing of FIG. 19B, the bookbinding apparatus 3 cuts the range of the designated region of the cover paper sheet P2 at the cut line L in consideration of a margin, and applies a glue G onto the spine P2R of the cut A3 cover paper sheet P2 and the range of the region to be cut as shown by the oblique lines in the drawing. As shown in the left drawing of FIG. 19B, the additional A4 paper sheet P1 with the image data for the cut part printed is pasted onto the part of the cover paper sheet P2 with the glue G applied. Further, as shown in FIG. 19C, the paper sheet bundle PS is pasted onto the spine P2R of the cover paper sheet P2 with the glue G applied to form the booklet B.

The present invention is not limited to only the above-described embodiment, but can be embodied by variously modifying the constitutional elements in a range without departing from the scope of the present invention in the implementation phase. Further, various variations of the present invention can be formed using appropriate combinations of plural constitutional elements disclosed in the embodiment. For example, some constitutional elements may be deleted from those shown in the embodiment. For example, in the case bookbinding of the embodiment, the adhesive applying unit 45 is used as a binding means for binding the cover paper sheet to the spine of the paper sheet bundle; however, a stapler may be used as the binding means.

The following are reference symbols in the figures:

1: Bookbinding system
2: Printing apparatus
3: Bookbinding apparatus
17: Printing control unit
21: External paper feeding base
23: Internal paper feeding base
43: Aligning unit as paper sheet bundle production unit
44: Clamp unit
45: Adhesive applying unit
46: Shaping unit
50: Bookbinding control unit as control unit
96: Rotary cutter unit
111: Booklet conveyance conveyor
P1: Text paper sheet
P2: Cover paper sheet
P2F: Front cover
P2B: Back cover
P2R: Spine
PS: Paper sheet bundle
PSF: Front surface of paper sheet bundle
PSB: Back surface of paper sheet bundle
PSa: Spine of paper sheet bundle
PSb: End surface on fore edge side of paper sheet bundle
E1: Edge of paper sheet bundle
E2: Edge of cover paper sheet
B: Booklet

The invention claimed is:

1. A bookbinding system comprising:

a plurality of paper feeding trays that stores paper sheets in a plurality of sizes respectively;

a paper sheet bundle production unit that uses the paper sheets supplied from one of the plurality of paper feeding trays as text paper sheets to produce a paper sheet bundle composed of the plural text paper sheets;

a shaping unit that uses a paper sheet supplied from one of the plurality of paper feeding trays as a cover paper sheet, contacts a spine of the paper sheet bundle and the cover paper sheet with each other, and shapes a booklet by binding the paper sheet bundle using the cover paper sheet by case binding; and a control unit that selects one of the plurality of paper feeding trays storing paper sheets having a size fitting within a region configured with a front surface, a back surface, and the spine of the paper sheet bundle, and allows the shaping unit to shape the booklet using the paper sheet stored in the one of the plurality of paper feeding trays as the cover paper sheet, wherein the control unit controls the shaping unit to adjust a relative arrangement of the paper sheet bundle and the cover paper sheet so that an area of a region covered with the cover paper sheet on the front surface of the paper sheet bundle is larger than an area of a region covered with the cover paper sheet on the back surface of the paper sheet bundle.

2. The bookbinding system according to claim 1, wherein the control unit selects the one of the plurality of paper feeding trays storing paper sheets whose length in a longitudinal or lateral direction matches a length in a direction orthogonal to a thickness direction at the spine of the paper sheet bundle when allowing the shaping unit to shape the booklet.

3. The bookbinding system according to claim 2, wherein the control unit controls the shaping unit to adjust the relative arrangement of the paper sheet bundle and the cover paper sheet, so that the case binding is carried out while allowing an edge of a front part of the cover paper sheet and an edge of the front surface of the paper sheet bundle to match each other.

4. The bookbinding system according to claim 3, wherein the control unit controls in such a manner that in a case where there is a printed image on a final page of the paper sheet bundle, the paper sheet bundle is formed by adding one text paper sheet next to the final page.

5. The bookbinding system according to claim 4, wherein the control unit controls in such a manner that in a case where there is a printed image on the final page of the paper sheet bundle, one text paper sheet is added only when at least a part of the printed image on the final page is exposed as a result of comparison between a printed region of the printed image on the final page and a covered region of the final page covered with a back part of the cover paper sheet.

6. The bookbinding system according to claim 5, further comprising clamp plate that conveys the paper sheet bundle produced by the paper sheet bundle production unit to the shaping unit, wherein the shaping unit comprises a cover paper sheet carrying roller conveying the cover paper sheet, a sheet sensor detecting the cover paper sheet conveyed by the cover paper sheet carrying roller, a rear-part bending plate bending a boundary part between a spine of the cover paper sheet and a front cover of the cover paper sheet, and a boundary part between the spine of the cover paper sheet and a back cover of the cover paper sheet, and an abutting plate on which an end surface on a back side of the paper sheet bundle conveyed by the clamp plate abuts through the cover paper sheet, and the control unit determines a position of the cover paper sheet with respect to the rear-part bending plate by operating the cover paper sheet carrying roller upon detection of the cover paper sheet by the sheet sensor, abuts the end surface on the back side of the paper sheet bundle on the abutting plate by the clamp plate through the cover paper sheet, and shapes the booklet by operating the rear-part bending plate when the cover paper sheet is conveyed to the shaping unit.

* * * * *